US008336939B2

(12) United States Patent
Green et al.

(10) Patent No.: US 8,336,939 B2
(45) Date of Patent: Dec. 25, 2012

(54) ROLL-ON, FOLDABLE LITTER AND PATIENT HANDLING SYSTEM FOR EMERGENCY TRANSPORT VEHICLES

(75) Inventors: Lowell A. Green, Littleton, CO (US); Ryan N. Mecklem, Parker, CO (US); Tyler Frederick LeMarinel, Denver, CO (US)

(73) Assignee: Air Methods Corporation, Englewood, CO (US)

( * ) Notice: Subject to any disclaimer, the term of this patent is extended or adjusted under 35 U.S.C. 154(b) by 186 days.

(21) Appl. No.: 12/897,554

(22) Filed: Oct. 4, 2010

(65) Prior Publication Data

US 2012/0080899 A1 Apr. 5, 2012

(51) Int. Cl.
*A61G 1/02* (2006.01)

(52) U.S. Cl. ..... 296/20

(58) Field of Classification Search ..... 296/20; 5/11

See application file for complete search history.

(56) References Cited

U.S. PATENT DOCUMENTS

| | | | |
|---|---|---|---|
| 5,022,105 | A | 6/1991 | Catoe |
| 5,372,339 | A | 12/1994 | Morgan |
| 5,383,629 | A | 1/1995 | Morgan |
| 5,497,968 | A | 3/1996 | Hewko |
| 5,738,306 | A | 4/1998 | Moss et al. |
| 5,779,296 | A | 7/1998 | Hewko |
| 5,785,277 | A | 7/1998 | Manning et al. |
| 5,927,423 | A | 7/1999 | Wada et al. |
| 6,003,813 | A | 12/1999 | Wentland et al. |
| 6,152,400 | A | 11/2000 | Sankrithi et al. |
| 6,152,401 | A | 11/2000 | Green |
| 6,155,519 | A | 12/2000 | Rajasingham |
| 6,273,366 | B1 | 8/2001 | Sprenger et al. |
| 6,332,638 | B1 | 12/2001 | Menna |
| 6,527,263 | B1 | 3/2003 | Verbrugge |
| 6,585,188 | B2 | 7/2003 | Alli |
| 6,669,141 | B2 | 12/2003 | Schmidt-Schaeffer |
| 6,923,606 | B2 | 8/2005 | Fehrle et al. |
| 7,028,351 | B1 | 4/2006 | Frieder et al. |
| 7,188,806 | B2 | 3/2007 | Beroth |
| 7,201,349 | B2 | 4/2007 | Lavie et al. |
| 7,328,926 | B1 | 2/2008 | Myers et al. |
| 7,360,742 | B2 | 4/2008 | Beroth |
| 7,364,119 | B2 | 4/2008 | Sprenger et al. |
| 7,389,552 | B1 | 6/2008 | Reed et al. |
| 7,578,471 | B2 | 8/2009 | Beroth |

OTHER PUBLICATIONS

Multidirectional Wheels & Mounts, Rotacaster, www.rotacaster.com, Sep. 28, 2010, 3 Pages.

Rotacaster Omni Wheels, Rotacaster, www.rotacaster.com, Sep. 28, 2010, 2 Pages.

*Primary Examiner* — Lori Lyjak

(74) *Attorney, Agent, or Firm* — Marsh Fischmann & Breyfogle LLP

(57) ABSTRACT

A patient transport litter and system includes a patient support platform interconnected to a foldable frame that may be supported by and rolled upon a first plurality of wheels in an unfolded state. In a folded state, a second plurality of wheels may be provided to support and allow for rollable movement of the patient transport litter. A leading plurality of wheels may be provided at one end of the patient support platform for initially and rolling upon engaging the floor of an emergency transport vehicle during loading of the patient transport litter thereupon. One or more of the plurality of wheels may comprise multi-directional wheels, e.g., to allow for omnidirectional rolling movement. The litter may be selectively lockable in and unlockable from the unfolded state, the fully-folded state, and optionally, one or more partially-folded state(s). In a system implementation, the patient transport litter and an emergency transport vehicle may include complimentary interconnection members to secure the patient transport litter to the emergency transport vehicle during transport.

26 Claims, 18 Drawing Sheets

ROLL-ON, FOLDABLE LITTER AND PATIENT HANDLING SYSTEM FOR EMERGENCY TRANSPORT VEHICLES

FIELD OF THE INVENTION

The present invention relates to the emergency transport of medical patients, and more specifically, to a portable litter and system for patient handling. The invention is particularly apt for use in connection with patient transport in emergency transport vehicles having side access ports for patient loading and unloading.

BACKGROUND OF THE INVENTION

In instances where a patient must be transported, and especially in emergency medical care situations, patients must typically be loaded into an emergency transport vehicle, transported from an emergency site (e.g., accident scene) to a medical facility (e.g., hospital or acute care facility), medically treated in route to the medical facility, and unloaded from the emergency transport vehicle for further medical treatment at the medical facility. In some situations, patients may be transported by more than one emergency transport vehicle in route to a medical facility. For example, a patient may be transported by a helicopter from an emergency site, then transferred to an ambulance for ground transportation to a medical facility.

As speed is of the essence in such situations, the loading, transporting, treating and unloading of the patient during this period should be conducted efficiently and effectively, and otherwise accommodate patient positioning for medical treatment. This is especially true in instances where an emergency pick-up site is in a remote area and/or medical evacuation situation. In this regard, the patient loading system and transport device should also be reliable and easy to operate.

In relation to the noted considerations, emergency transport vehicles typically present significant space constraints. This is particularly true for emergency transport vehicles having only side access ports for patient loading/unloading. In such arrangements, a patient litter may be raised and advanced into a side access port and translated from an orientation that is transverse to a longitudinal axis of the emergency transport vehicle (e.g., orthogonal) to an orientation that is aligned with the longitudinal axis. As may be appreciated, the performance of such translation in a small space, and in rapid and safe manner, presents significant challenges for medical personnel.

SUMMARY OF THE INVENTION

Accordingly, an object of the present invention is to provide an easy-to-use patient transport litter and system for loading patients into and unloading patients out of an emergency transport vehicle, e.g., a helicopter or other aircraft, and for otherwise transporting and facilitating the treatment of such patients.

It is another object of the present invention to provide an improved patient transport litter capable of readily assuming different orientations on a support surface during loading, unloading and/or transporting of a patient. In this regard, a related objective is to provide an improved patient transport litter capable of being maneuvered onto and within emergency vehicles having only side access ports.

Yet another object of the present invention to provide a patient transport litter and system capable of enhancing the delivery of emergency medical treatment during transport.

One or more of the above-noted objectives are realized by the portable patient transport litter and system of the present invention. In one aspect, a patient transport litter may include a patient support platform for supporting a patient thereupon, and a frame interconnected to the patient support platform and selectively foldable between an unfolded state and a folded state.

By way of example, the litter may be moved to an emergency transport vehicle in an unfolded state, then folded and loaded onto the emergency transport vehicle in a folded state. In the later regard, the litter may further include a first plurality of wheels interconnected to the frame for rollable movement and supporting the frame and patient support platform when the frame is in a folded state, wherein each of the first plurality of wheels is multi-directional. More particularly, for a given orientation of the first plurality of wheels, the portable patient transport litter may be rollable in at least two different and preferably all directions (e.g., omnidirectional) when the frame is in a folded state (e.g. when loaded on to an emergency transport aircraft). Such capability facilitates space-efficient translation of a folded litter from an orientation transverse to a longitudinal axis of an emergency transport vehicle to an orientation aligned with such axis. In this regard, the improved patient transport litter is particularly apt for use with emergency transport vehicles having only side access ports for loading/unloading patients.

In various embodiments, the patient transport litter may further comprise a second plurality of wheels interconnected to the frame for roll supporting and rollable movement of the frame and the patient support platform with the frame in the unfolded state. For example, a patient may be placed on the litter with the frame unfolded and rolled from an initial patient loading site (e.g. an emergency site) to an emergency transport vehicle. Further, the second plurality of wheels may be utilized to roll the litter on to and within certain types of emergency transport vehicles (e.g. ambulances) and/or within a medical facility after emergency transport.

In certain implementations, the patient transport litter may further include a third, or leading, plurality of wheels interconnected to and extending away from a first end portion of the patient support platform. Such first end portion may correspond with an end of the patient support platform that is intended to be first advanced into an emergency transport vehicle (e.g. an end intended for supporting a lower body portion of a patient), wherein the third plurality the wheels may roll on engage a floor of an emergency transport vehicle (e.g. a helicopter) in an initial stage of patient loading, e.g. with the frame being folded to a folded state. The third plurality of the wheels may be multi-directional, wherein for a given orientation of the third plurality of wheels, the first end portion of the patient support platform is rollable in at least two different directions and preferably all directions (e.g., omnidirectional). Such feature further facilitates litter positioning within a relatively small cabin area of an emergency transport vehicle.

By way of example, when multi-directional wheels are utilized for the first plurality and/or third plurality of wheels, each of such plurality of wheels may include at least a plurality of roll members that are interconnected and disposed about a circle for co-rotation together about a wheel rotational axis. Further, each of such roll members may be separately rollable about a corresponding roller axis that is transverse to the wheel rotational axis (e.g. substantially orthogonal). As may be appreciated, such an arrangement facilitates rollable, multi-directional movement in at least two different directions, e.g., omnidirectional movement in all directions, thereby facilitating litter maneuverability within a relatively small space. In this regard, multi-directional wheels may be rolled without swiveling, or rotating, a caster.

In some implementations, the foldable frame may comprise an upper first frame portion pivotally interconnected to a patient support platform, and a lower second frame portion, wherein the first frame portion is also pivotally interconnected to the second frame portion. By virtue of such pivot interconnections, the patient support platform may be selectively pivoted between a first pivot position with the frame in an unfolded state, and a second pivot position with the frame in a folded state (e.g., wherein the first position may be elevated relative to the second position). Further in this regard, the patient transport litter may be provided so that the patient support platform is maintainable in a predetermined orientation relative to the second frame portion (e.g. substantially parallel thereto) when the frame is in either the unfolded state or folded state, and throughout pivotal movement of the patient support platform between the corresponding first and second pivot positions.

Furthermore, the patient transport litter may be selectively controllable to be locked with the patient support platform in an unfolded state, a folded state and/or a partially-folded state, and to be selectively unlocked from any of such state(s). In one implementation, the patient transport litter may be selectively locked into and unlocked from each of a fully-unfolded state, a fully-folded state and at least one intermediate state therebetween, wherein in the intermediate state a patient may be positioned at an intermediate height to facilitate the provision of medical care (e.g., cardiopulmonary resuscitation (CPR)).

In some embodiments, the patient transport litter may be provided so that the first frame portion may be longitudinally moveable relative to the patient support platform. In turn, the patient support platform may be moveable from a first longitudinal position relative to the first frame portion to a second longitudinal position relative to the first frame portion in conjunction with pivotal movement of the patient support platform between first and second pivot positions. In certain implementations, the first frame portion may be pivotally interconnected to the patient support platform at interconnection locations that are longitudinally moveable along the patient support platform (e.g., slidably and/or rollable along the patient support platform).

In one approach, a first plurality of wheels may be interconnected to a first frame portion for rollable movement of and for supporting the frame and the patient support platform when the frame is in a folded state (e.g. when loaded on to an emergency transport vehicle), and a second plurality of wheels may be interconnected to a second frame portion for rollable movement of and for supporting the frame and patient support platform when the frame is in an unfolded state. Additionally, a third plurality of wheels may be interconnected to a first end of patient support platform for rollable movement of and for supporting the first end in conjunction with patient loading and/or unloading from an emergency transport vehicle (e.g. an aircraft). In this regard, the third plurality of wheels may be fixedly disposed at a first distance from the patient support platform and the first plurality of wheels may be spaced at a second fixed distance from the patient support platform with the frame in a folded state, wherein the first distance is less than the second distance. For example, the first and third plurality of wheels may be provided so that, when the patient transport litter is fully positioned onto an emergency transport vehicle, the first plurality of wheels are disposed to support the patient support platform and roll upon a floor of the emergency transport vehicle, and the third plurality of wheels are disengaged from the floor of the emergency transport vehicle.

In another aspect, the patient transport litter may be adapted for selective interconnection to and disconnection from a connection member mounted to an emergency transport vehicle (e.g., fixedly connected to a floor of the emergency transport vehicle). In various embodiments, the frame of the patient transport litter may comprise a plurality of connection locations disposed along a length of the litter, wherein a selected one of the plurality of the connection locations may be interconnected to a complimentary connection member mounted to an emergency transport vehicle. As may be appreciated, the provision of a plurality of different connection locations facilitates selective fixed positioning of a patient transport litter at any one of a plurality of positions within an emergency transport vehicle, thereby facilitating access by medical personnel to a patient disposed on the litter during patient transport.

In one arrangement, the portable patient transport litter includes a longitudinal member extending along a portion of a length of the patient transport litter, e.g. below the patient support platform. Relatedly, a connection receiver mounted to the floor of an emergency transport vehicle may include a u-shaped channel, oriented and sized to receive the longitudinal member. The connection member may further include a closure member for closing the u-shape channel when the longitudinal member is located therewithin. Such an arrangement restrains lateral, side-to-side movement of the litter relative to the receiver, while allowing relative longitudinal movement of the litter relative to the receiver, e.g. in a direction aligned with a longitudinal axis of the channel of the receiver.

In one implementation, to restrain relative longitudinal movement of the longitudinal member and litter, relative to the receiver, a plurality of apertures may be provided along a length of the longitudinal member. Correspondingly, the receiver may include a spring-loaded pin member sized for receipt within any selected one of the apertures. A first control member may be provided to selectively retract the pin member against the loading of a spring member to facilitate relative aligned positioning of and locking interface between the pin member of the receiver and the longitudinal member. Further, a second control member may be provided to selectively open the closure member to allow the longitudinal member to be removed from the u-shaped channel.

In a further related aspect, a first end of the patient transport litter may be adapted for selective engagement with a retention member interconnected to an emergency transport vehicle at a side access port thereof. Such retentive engagement may be established during at least a portion of a patient unloading procedure, e.g. to establish an anchor location as the patient transport litter is unloaded from an emergency transport vehicle.

In one approach, a lateral member may be interconnected to a first end of the patient support platform, wherein the lateral member extends below and along at least a portion of a width of the patient support platform. Correspondingly, a retention member interconnected to the emergency transport vehicle at the side access port thereof may define an inward-facing (e.g., toward the interior of the helicopter), u-shaped recess for receiving the lateral member therewithin. By way of example, the first end of the litter may be maneuvered to locate the lateral member in the retention member.

As may be appreciated, an inventive patient handling system that includes a connection member and/or a retention member interconnected to an emergency transport vehicle, together with one or more above-noted features of a patient transport litter, is also provided. Such patient handling system may be utilized so that a patient may be loaded a single time on to a patient transport litter and reliably loaded onto, readily positioned, and secured within, and unloaded from an emergency transport vehicle.

In conjunction with the present invention, an improved method for emergency transport patient transport also is provided. The method may include the steps of positioning a patient on a patient support platform of a portable patient transport litter, and moving the litter, with the patient disposed thereupon, to an emergency transport vehicle. The method may further include the steps of loading the portable patient transport litter, with the patient disposed thereupon, into the emergency transport vehicle (e.g. through a side access port located on a side of the emergency transport vehicle), and rolling the portable patient transport litter on a first plurality of wheels (e.g., multi-directional wheels) of the portable patient transport litter to a desired location within the emergency transport vehicle, wherein for a given common orientation of the first plurality of wheels the portable patient transport litter is rollable in at least two different directions and preferably in all directions.

In one approach, the rolling step may comprise rotating each of the first plurality of wheels about a corresponding wheel rotation axis in a first direction (e.g. on a floor of an emergency transport vehicle), wherein each of the first plurality of wheels includes at least a first plurality of roll members interconnected and disposed about a circle. In turn, the rolling step may further include rolling at least one of the first plurality of roll members of each of the first plurality of wheels in a second direction transverse to the first direction.

The moving step of the inventive method may include rolling the portable patient litter, with the patient disposed thereupon, on a second plurality of wheels comprising the portable patient transport litter. By way of example, a portion of such rolling step maybe completed after the positioning of a patient on the litter and prior to the loading step (e.g. during transport from an emergency site to an emergency transport vehicle).

In another aspect, the loading step of the method may include folding a frame of the portable patient transport litter from unfolded state (e.g., expanded) to a folded state (e.g., collapsed). In one arrangement, the frame may include an upper, first frame portion and a lower, second frame portion, wherein the folding step includes pivoting the patient support platform, with the patient disposed thereupon, relative to the first frame portion, and pivoting the first frame portion relative to the second frame portion. In one implementation, the folding step may further include moving the first frame portion relative to the patient support platform with the patient disposed thereupon. For example, the first frame portion may be disposed to slide or roll along the patient support platform during at least a portion of the folding step.

In certain implementations the method may further include the steps of locking the patient transport litter in the unfolded sate, and unlocking the patient transport litter from the unfolded state prior to the folding step. In addition, the method may include locking the patient transport litter in a fully-folded state and unlocking the litter from the fully-folded state. By way of example, locking in the fully-folded state and/or unfolded state may be realized automatically. Further, the method may include locking the patient transport litter in a partially-folded state, and unlocking the patient transport litter from the partially-folded state. In this regard, such locking may be realized automatically in conjunction with folding the patient transport litter (e.g., automatic locking may be provided at an intermediate, partially-folded state to facilitate the application of CPR procedures).

In one implementation, the step of loading the transport litter into the emergency transport vehicle may include rolling a first end portion thereof on a second or leading plurality of wheels comprising the transport litter. In this regard, the second plurality of wheels may be multi-directional, wherein for a given orientation of the second plurality of wheels the transport litter is rollable in at least two different directions and preferably in all directions. In this regard, each of the second plurality of wheels may include at least a first plurality of roll members interconnected and disposed about a circle. In turn, rolling of the first end portion of the litter may include rotating each of the second plurality of wheels about a corresponding wheel rotation axis in a first direction, and rolling at least one of the first plurality of roll member of each of the second plurality of wheels in a second direction.

In yet another aspect, an inventive method may include connecting the transport litter at the above-referenced desired location within the emergency transport vehicle. For example, such interconnection may entail positioning of a first connection member of the transport litter within a receiver fixed to the emergency transport vehicle at the above-referenced desired location within the emergency transport vehicle, wherein the transport litter is restrained from movement in at least one direction by the receiver. By way of example, the first connection of the transport litter may comprise a longitudinal member extending below and along the patient support platform. Relatedly, the receiver may comprise a u-shaped channel aligned or parallel to a longitudinal axis of the emergency transport vehicle. In conjunction with the above-noted positioning step, the method may further include the steps of adjusting the position of the transport litter relative to and with the first connection member located within the receiver, and releasably locking the transport litter into a selected one of a plurality of different available transport positions relative to the receiver. Such arrangement may also be adapted to allow for position adjustment and releasable locking of the litter in a desired, fixed position relative to the second emergency transport vehicle.

In a further additional aspect, the method may include loading the transport litter, with the patient disposed thereupon, into a second emergency transport vehicle. In this regard, the method may further include positioning a second connection member of the transport litter within another connector fixed to the second emergency transport vehicle so as to restrain the transport litter from movement in at least one direction.

Numerous additional features and advantages of the present invention will become apparent to those skilled in the art upon consideration of the embodiment descriptions provided hereinbelow.

DETAILED DESCRIPTION

Figure 1:
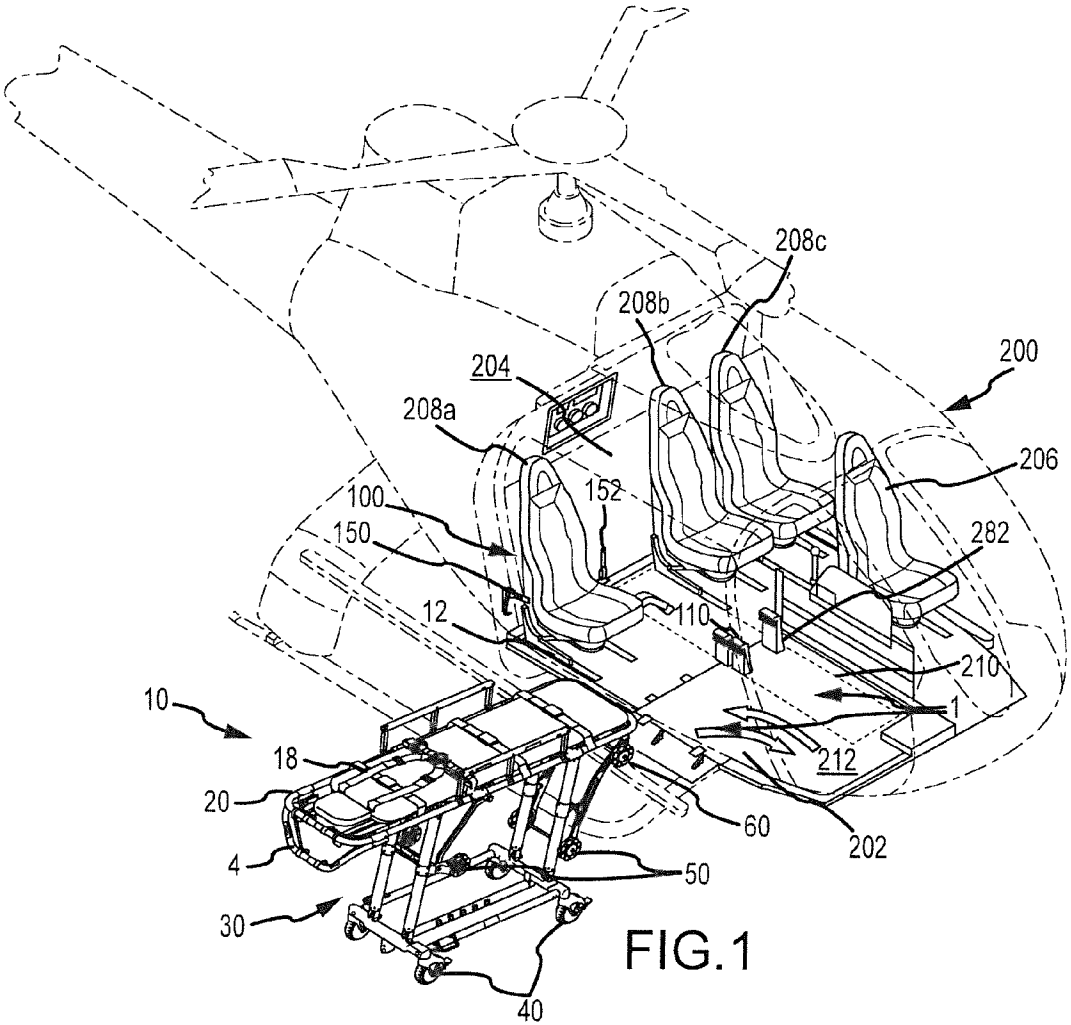
FIG. 1 is a perspective view of a patient handling system embodiment showing a patient transport litter positioned adjacent to emergency transport vehicle.

FIGS. 1-8 illustrate one embodiment of a patient handling system 1 comprising features of the present invention. Various alternative implementations of such features are within the scope of the invention.

The patient handling system 1 includes a portable patient transport litter 10 and an interconnection assembly 100 disposed within an emergency transport vehicle 200. In the illustrated embodiment, emergency transport vehicle 200 may be a helicopter having a side access port 202 for accessing a cabin area 204. The cabin area 204 is adapted to include an operator station 206 (e.g., a pilot cockpit seat) and at least one or a plurality of medical personnel transport stations 208*a*, 208*b*, 208*c* (e.g., flight seats). Further, cabin area 204 may comprise a predetermined area 210 within which patient transport litter 10 may be selectively positioned for connection with a floor-mount receiver 110 operable by hand-control members 150, 152 of the interconnection assembly 100. As illustrated, stations 208*a*, 208*b*, 208*c* may be disposed adjacent to the predetermined area 210 to provide medical personnel with patient access during emergency transport. In the illustrated embodiment, stations 208*a*, 208*b* are located on different sides of the predetermined area 210.

FIG. 1 illustrates the patient transport litter 10 prior to loading on to emergency transport vehicle 200. FIGS. 2-8 illustrate various positions of patient transport litter 10 upon emergency transport vehicle 200. For purposes of explanation, FIGS. 1-8 are presented without the presence of system users. By way of example, in use of the system 1, a patient may typically be retainably positioned on the patient transport litter 10 with patient harness straps 18. Further, medical personnel may typically be located at a first end 12, or on each side of the litter 10, and at a second end 14 of patient transport litter 10 for loading at emergency transport vehicle 200. Additionally, a vehicle operator may be located at operator station 206, and one to three medical personnel would be located within the cabin 204 (e.g., at stations 208*a*, 208*b* and 208*c* after helicopter takeoff) to provide medical care to the patient during air transport.

In FIG. 1, patient transport litter 10 is shown in an approach position relative to emergency transport vehicle 200. In this regard, the patient support litter 10 may be located by medical personnel so that the first end 12 thereof (e.g., an end at which the patient's feet would typically be located) is oriented for advancement relative to an openable/closeable side access port 202 to cabin area 204 of the emergency transport vehicle 200. For example, the patient support litter 10 may be positioned transverse to, e.g., substantially orthogonal to, a longitudinal axis of the emergency transport vehicle.

The patient transport litter 10 may include a patient support platform 20 supported by and pivotally connected to a frame 30, wherein the frame 30 may be selectively pivoted by medical personnel between an unfolded, (e.g., raised) state, and a folded, (e.g., collapsed) state, relative to the patient support platform 20, e.g., for loading on to emergency transport vehicle 200. To facilitate rolling movement in an unfolded state, a first plurality of wheels 40 may be connected to frame 30. Similarly, to facilitate rolling movement in a folded state, a second plurality of wheels 50 may be connected to frame 30. In FIG. 1, the frame 30 of patient transport litter 10 is in an unfolded state, wherein the patient transport litter 10 may be rolled on wheels 40 from a location at which a patient may be initially positioned and secured thereupon to a position adjacent to the emergency transport vehicle 200 for loading of the patient transport litter 10 thereupon by medical personnel located at each end of the patient transport litter 10.

Figure 2:
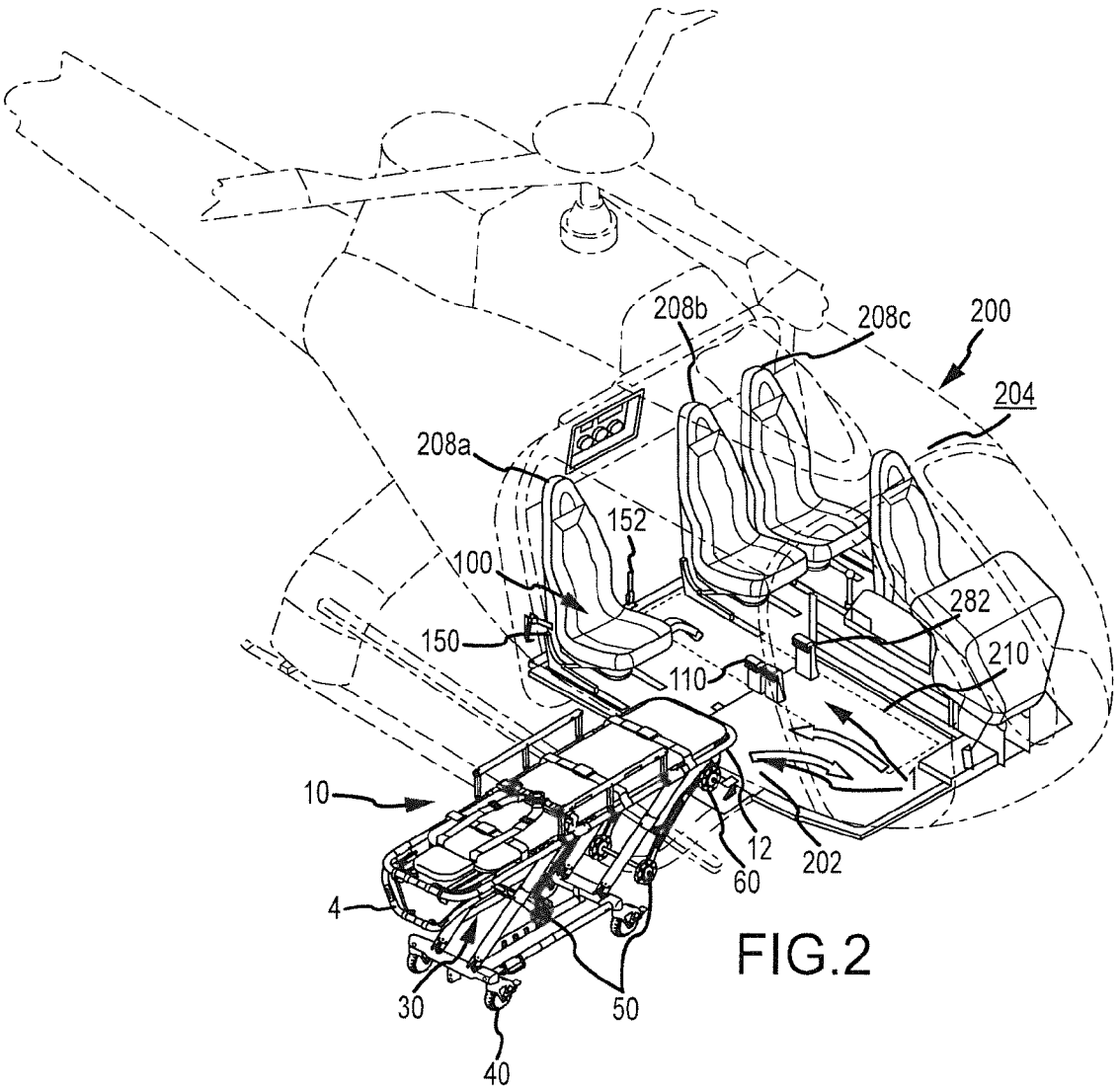
FIG. 2 is a perspective view of a patient handling system embodiment of FIG. 1 showing the patient support litter being folded in conjunction with loading into the emergency transport vehicle in a fully unfolded or raised position.
Figure 3:
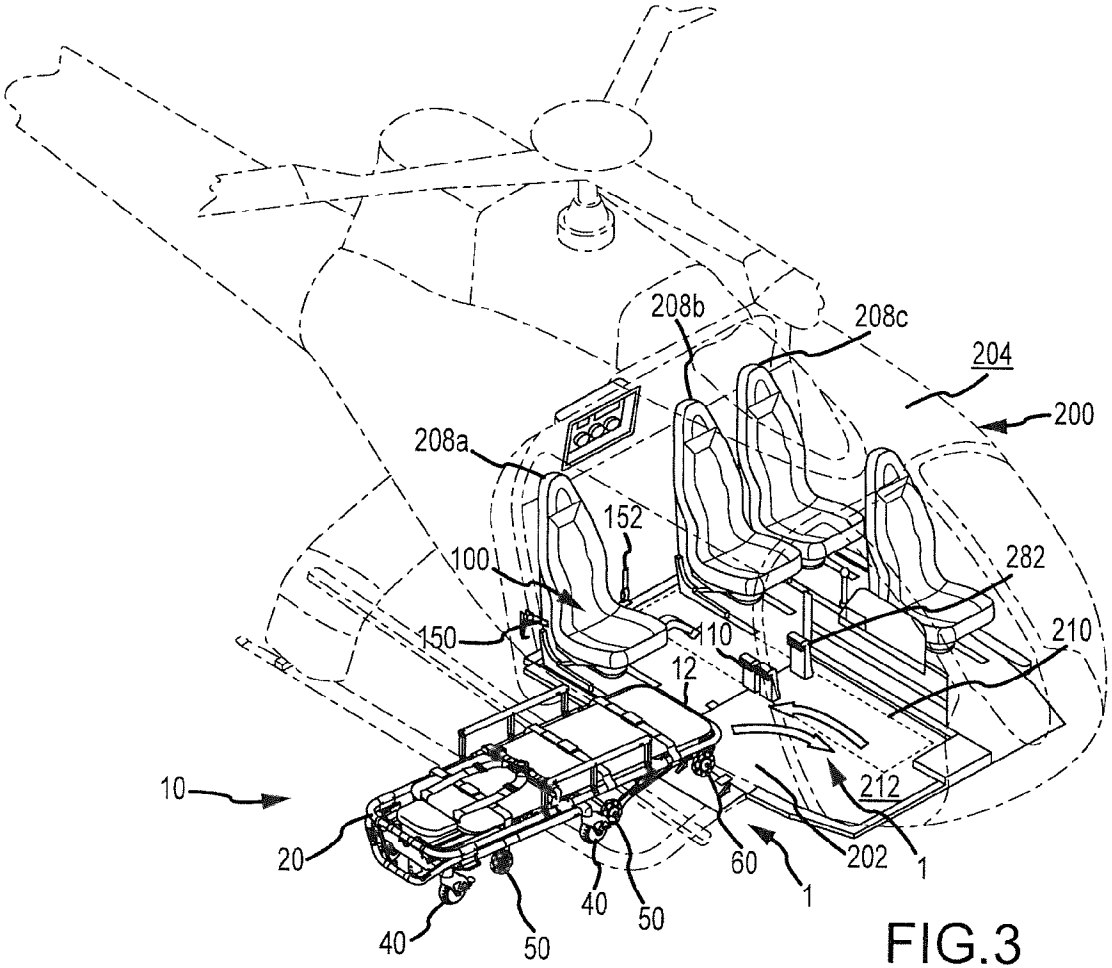
FIG. 3 is a perspective view of the patient handling system embodiment of FIGS. 1 and 2 showing the patient transport litter fully-folded at the side access port of the emergency transport vehicle.

In that regard, and as shown in FIGS. 2 and 3, the patient transport litter 10 may be positioned by medical personnel so that the first end 12 may be advanced into the side access port 202 (e.g., by elevating/advancing first end 12). Correspondingly, a control member 4 of the patient transport litter 10 may be manipulated by medical personnel so that the frame 30 may be selectively pivoted relative to patient support platform 20 by medical personnel in a direction away from the first end 12 (e.g., in a clockwise direction), wherein the frame 30 is essentially folded from the raised, unfolded state to a collapsed, folded state. To facilitate such pivotal movement and maintain a desired center of mass and compactness, the frame 30 may be interconnected to the patient support platform 20 for longitudinal movement relative thereto (e.g., slidable or rollable movement along the patient support platform 20). For example, upon pivotal movement of frame 30 relative to patient support platform 20, the frame 30 may move (e.g., slide or roll) towards the second end 14 of the patient transport litter 10.

A first end 12 of patient transport litter 10 may be provided with a leading plurality of wheels 60 connected thereto. Wheels 60 may be disposed for initial rolling engagement with a floor 212 within the cabin area 204 of the emergency transport vehicle 200. As may be appreciated, the provision of wheels 60 allows medical personnel to advantageously advance and position a portion of the patient transport litter 10 into the side access port 202. Further, wheels 60 also facilitates medical personnel handling of the first end 12 of the patient transport litter 10 during unloading procedures.

Figure 4:
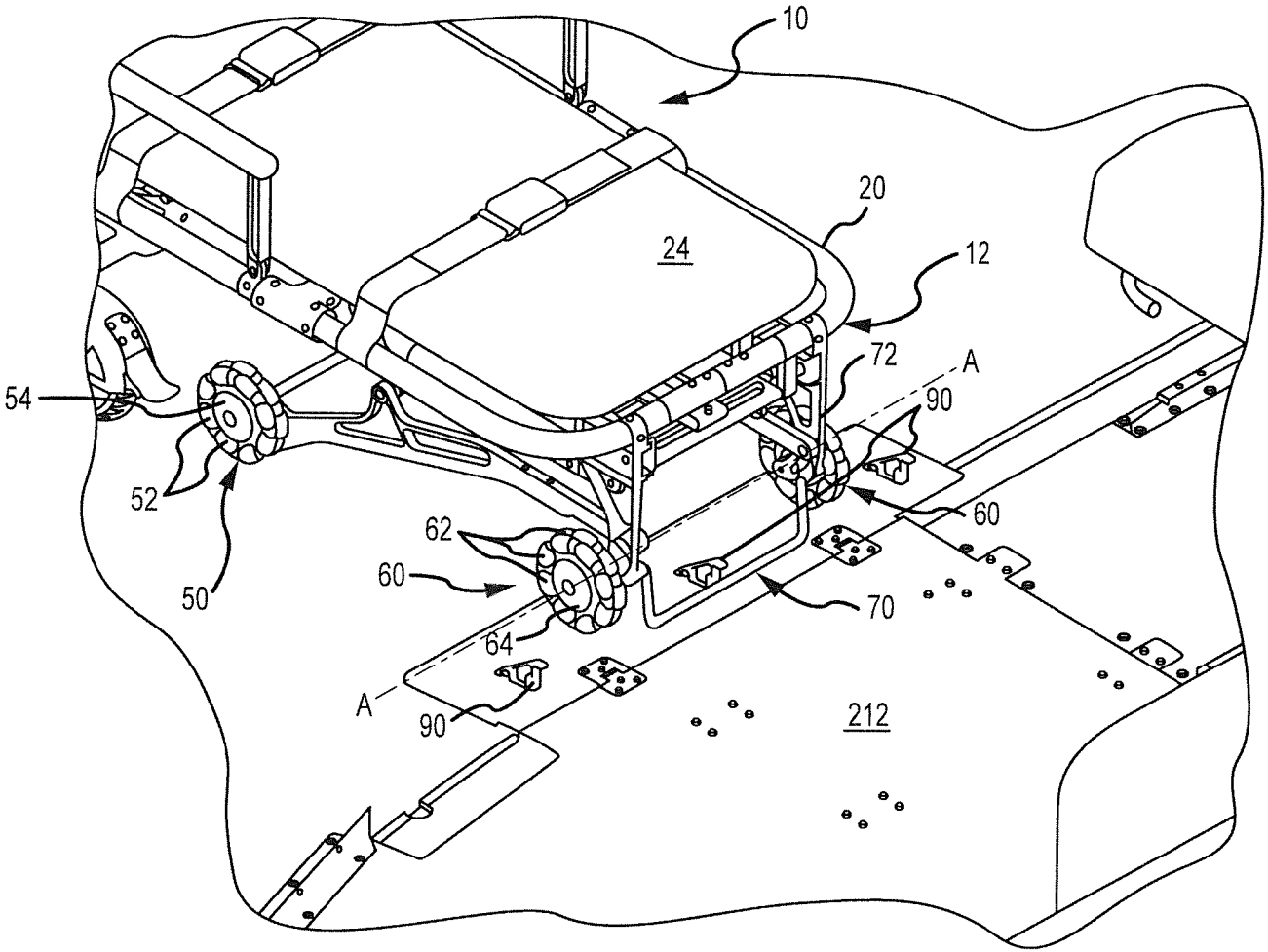
FIG. 4 is a perspective view of the patient handling system embodiment of FIGS. 1-3 showing a first end of the patient transport litter engaging a retention member at a side access port of the emergency transport vehicle.

In that regard, and as shown in FIG. 4, the first end 12 of patient transport litter 10 may include a downward-oriented lateral member 70 adapted to engage at least one upstanding retention member 90 located at the side access port 202 of the emergency transport vehicle 200. That is, when first end 12 of patient transport litter is rolled from a position within cabin area 204 to that illustrated in FIG. 4, the lateral member 70 may "automatically" engage a retention member 90. For such purposes, a u-shaped catch recess of retention member 90 may be located at a distance above the floor 212 that encompasses a distance at which lateral member 70 may be located when first end 12 is supported by wheels 60.

The lateral member 70 may comprise an elongated shaft interconnected to and extending below and substantially parallel to a first end of the patient support platform 20 (e.g., extending along a width of the patient support platform 200). Opposing ends of the lateral member 70 may be interconnected to the patient support platform 20 by brackets 72 that extend away from the first end 22 of the patient support platform 20 at locations below a top surface 24 of the patient support platform 20. As noted, the retention member(s) 90 may comprise a u-shaped catch recess that faces inwardly (e.g., toward cabin area 204) and is sized to receive the lateral member 70. A plurality of retention members 90 may be spaced across the access port 202 to facilitate engagement across a range of relative positions.

In certain implementations, the access port 202 may also be provided with an optional ramp member 270 interconnected to the floor 212 by one or more hinges 272. In one arrangement the hinged interconnection may be provided so that ramp member 270 may be pivoted from an upright transport position to a downward, outwardly-angled position for loading and unloading litter 10.

As illustrated in FIG. 4, wheels 60 of litter 10 may comprise multidirectional wheels that are each provided with a plurality of rollers 62 disposed about a circular periphery of a wheel hub 64, wherein each of the wheels 60 is rotatable about a corresponding wheel rotation axis AA. Further, each of the rollers 62 may be provided for separate rotation about corresponding roll axes, wherein the roll axes of rollers 62 are disposed in a common plane or parallel planes. Such an arrangement allows for rolling advancement of the first end 12 of the patient transport litter 10 within cabin area 204 an omnidirectional manner via rotation of wheels 60 in a first direction and rotation of rollers 62 in a second direction transverse to the first direction. In turn, patient positioning to, within and from the predetermined area 210 is facilitated. In one implementation, multidirectional wheels 60 may comprise Rotacaster omni wheels marketed by Rotacaster Ltd. of Newcastle, Australia.

Figure 5:
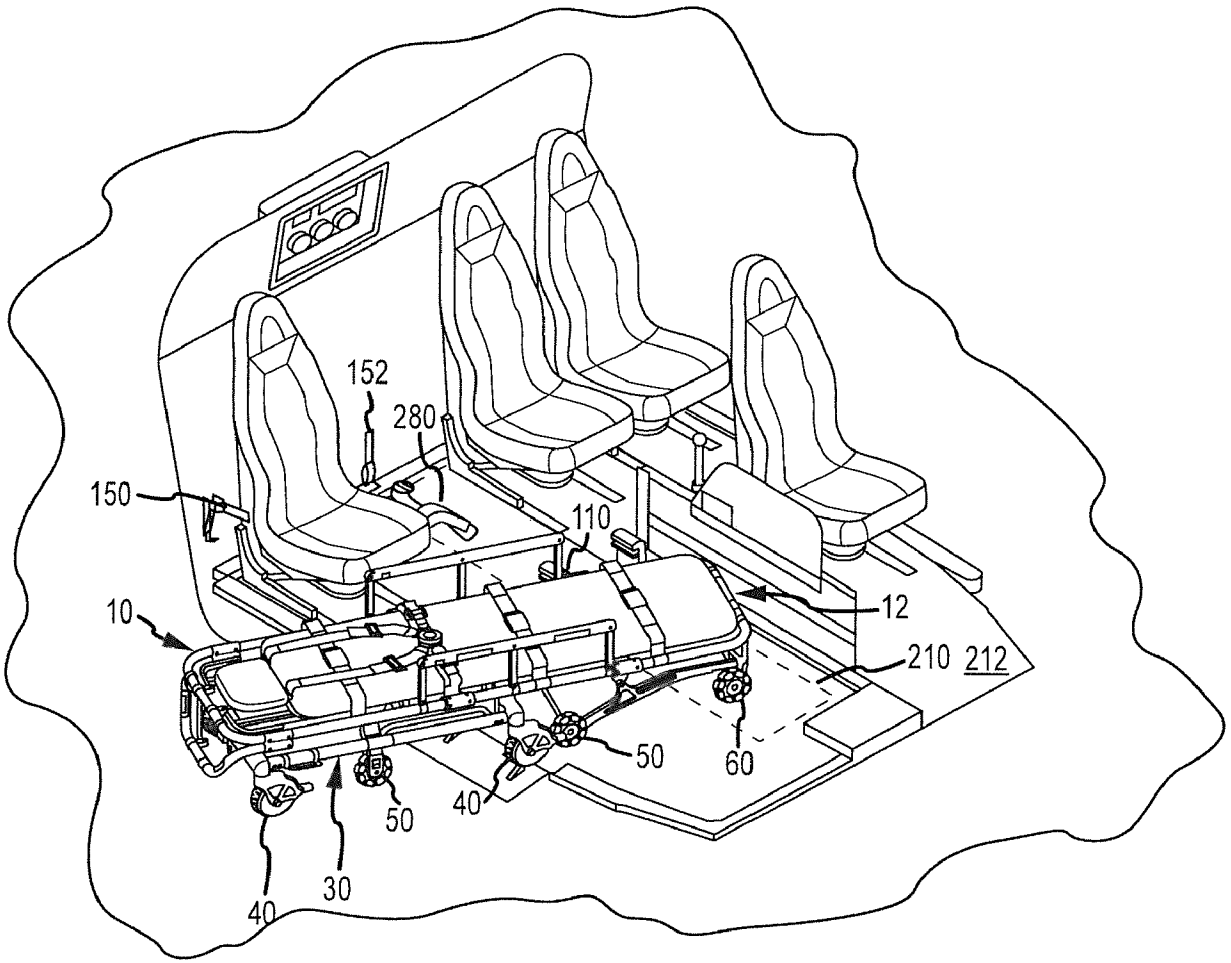
FIG. 5 is a perspective view of the patient handling system embodiment of FIGS. 1-4 showing the patient transport litter partially advanced into the emergency transport vehicle.

Further in this regard, reference is now made to FIG. 5 in which the first end 12 of patient transport litter 10 has been advanced into the emergency transport vehicle 200. In conjunction with such advancement, two of the second plurality of wheels 50 interconnected to frame 30 have engaged and are rollable upon the floor 212 of the cabin area 204. In conjunction with such engagement, patient transport litter 10 has been rolled in a clockwise direction. In this regard, the second plurality of wheels 50 may also be multi-directional, e.g., the same or similar to those described above in relation to the leading plurality of wheels 60. As illustrated in FIG. 5, the second plurality of wheels 50 may be disposed so that the patient transport litter 10 may be rolled any desired direction on the leading plurality of wheels 60 and the forward two of the second plurality of wheels 50.

Figure 8:
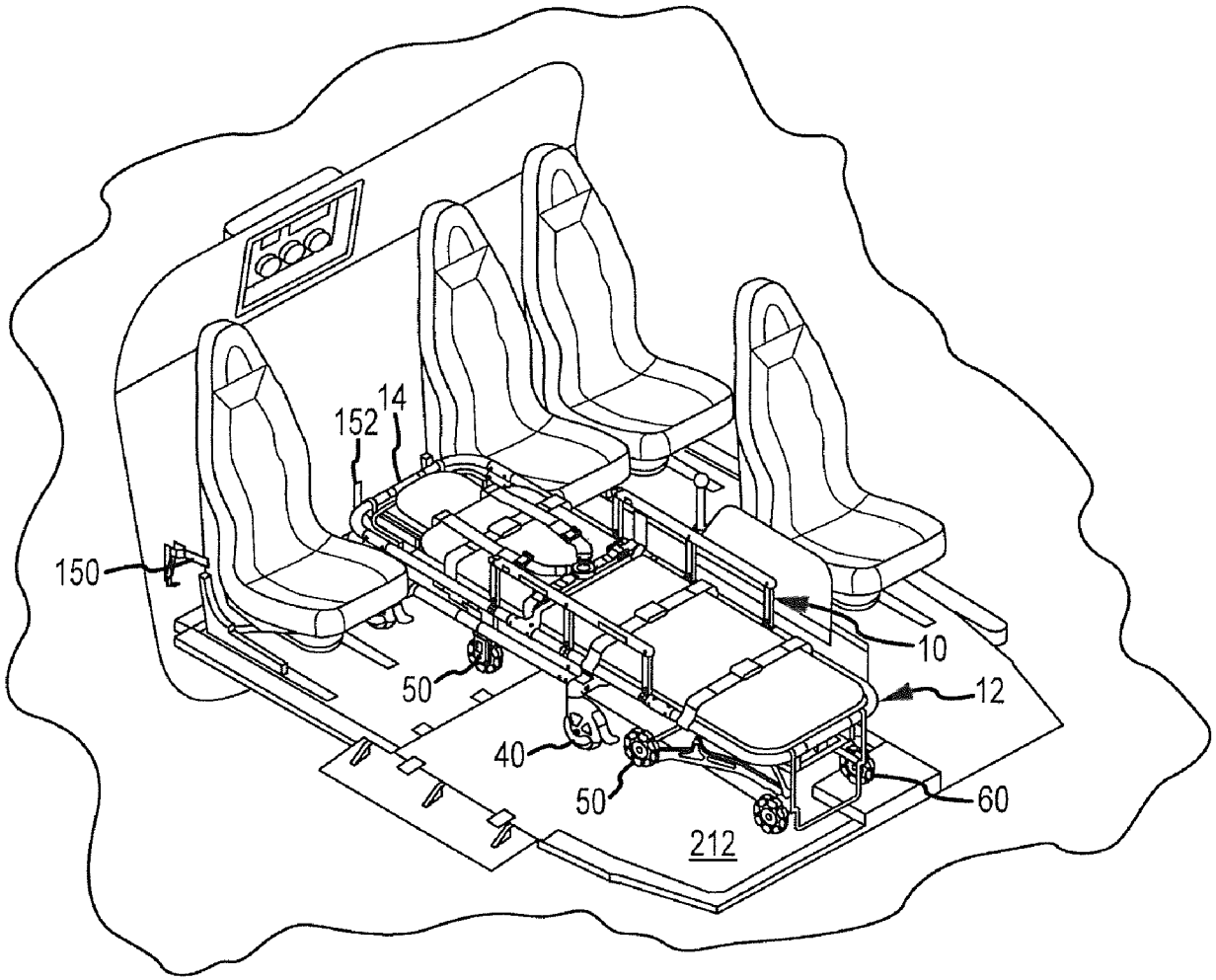
FIG. 8 is a perspective view of a patient handling system embodiment of FIGS. 1-7 showing the patient transport litter rolled to a rearward position between workstation for medical personnel.

As shown in FIG. 5, a first roll-restraint member 280 may be interconnected to floor 212 for engaging the patient transport litter 10 when located in a rearward, stowed position, as will be further described below in relation to FIG. 8. First roll-restraint member 280 includes a forward-projecting pin for insertion into a corresponding aperture located at the first end 12 of the patient transport litter 10. First roll-restraint member 280 restrains the first end 12 of litter 10 from lifting off the floor 212 and moving forwardly, e.g. in the event the nose of the emergency transport vehicle 200 moves downward relative to the back end thereof. Similarly, and as shown in FIGS. 1-3, a second roll-restraint member 282 may be mounted to the floor 212 on one side of the predetermined area 210. The second roll-restraint member 282 may comprise a laterally-projecting pin for insertion into an aperture on a side of the litter 10. The second roll-restraint member 282 restrains the litter 10 from rolling, or tipping, sideways, e.g., in the event one side of the emergency transport vehicle 200 moves downward relative to the other side.

Figure 6:
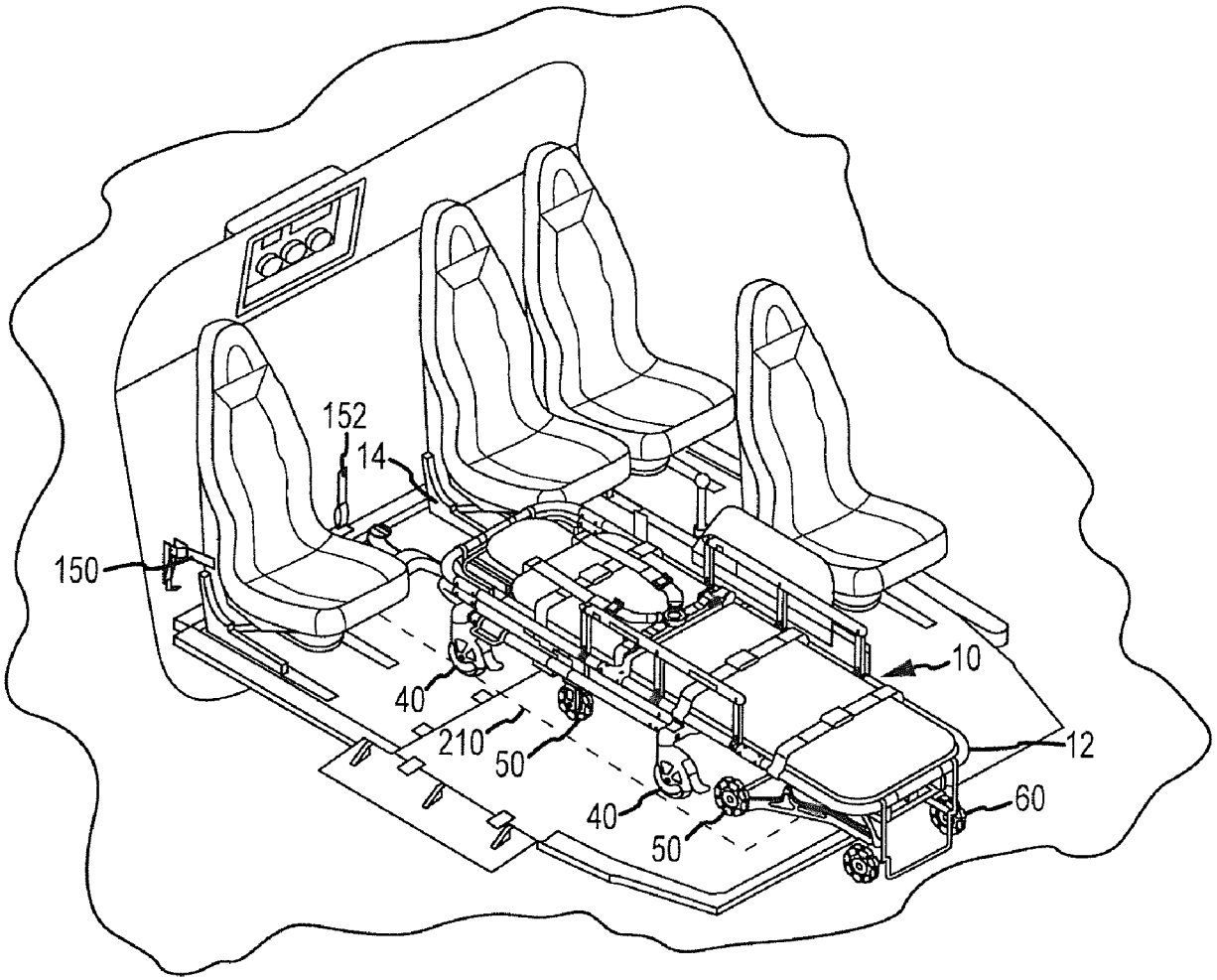
FIG. 6 is a perspective view of the patient handling system embodiment of FIGS. 1-5 showing the patient transport litter being fully advanced into the emergency transport vehicle.

Reference is now made to FIG. 6, which shows the patient transport litter 10 fully advanced into the emergency transport vehicle 200, wherein a second end 14 thereof has entered the cabin area 204 with the patient transport litter 10 being further rotated in a clockwise direction. In conjunction with such advancement, the two trailing wheels of the second plurality of wheels 50 have engaged the floor 212 of the cabin area 204. Correspondingly, the leading plurality of wheels 60 have disengaged the floor 212. Again, the utilization of multidirectional wheels for the leading plurality of wheels 60 and the second plurality of wheels 50 facilitates the positioning of patient transport litter 10 within a relatively small amount of space.

As illustrated in FIG. 6, the patient transport litter 10 has been positioned at the predetermined area 210. In such position, the patient transport litter 10 is adapted for connection to the interconnection assembly 100. In this regard, reference is now made to FIG. 7 which illustrates a perspective, cut-away view of the patient transport litter 10 and receiver 110 of interconnection assembly 100 mounted to the floor 212. The patient transport litter 10 includes a longitudinal member 80 disposed below the patient support platform 20 and frame 30. The longitudinal member 80 may comprise an elongated member extending along a length of the patient transport litter 10. The longitudinal member 80 may be interconnected at opposing ends to the frame 30 by bracket members 84.

Figure 7:
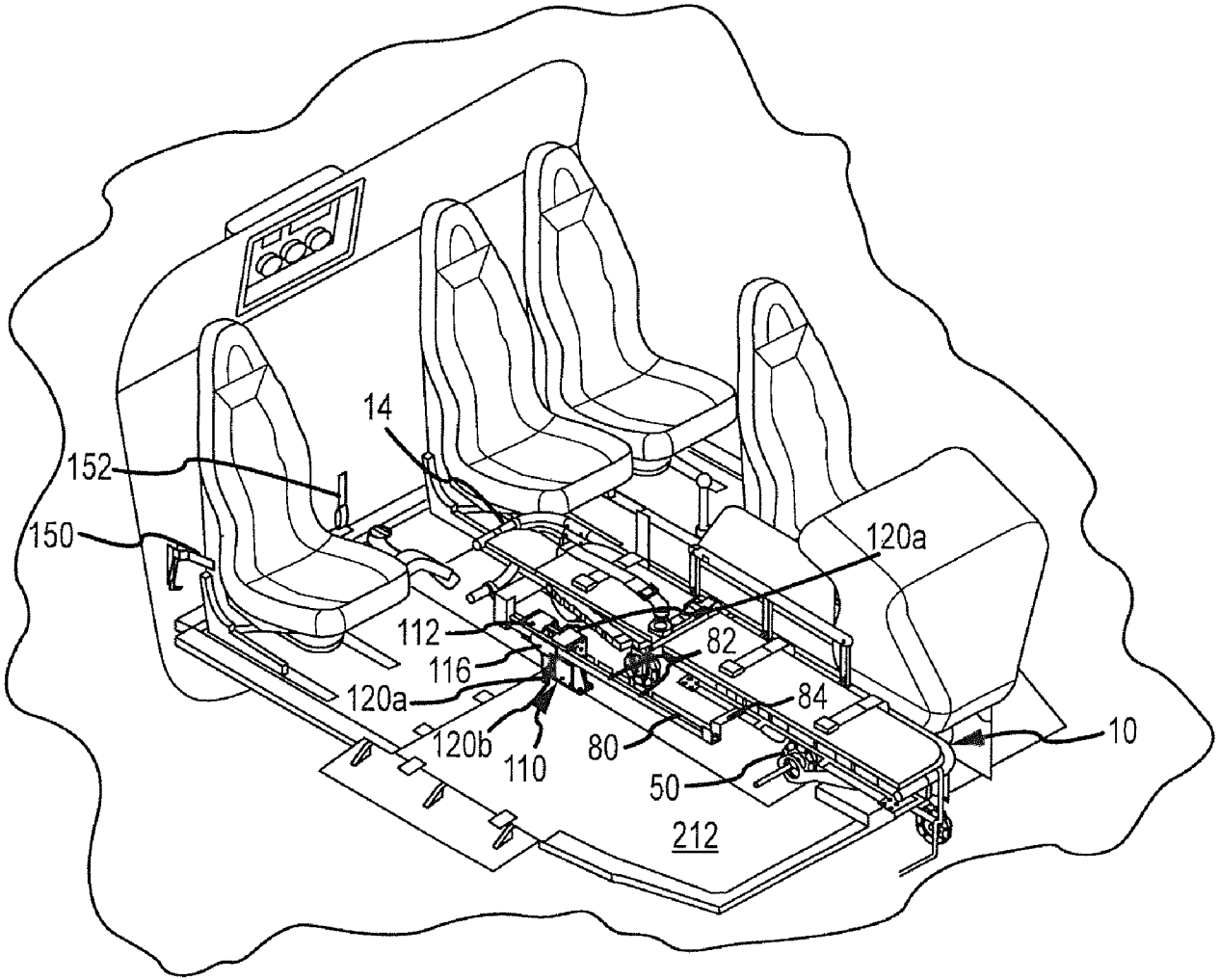
FIG. 7 illustrates the patient handling system embodiment of FIGS. 1-6 with the patient transport litter located the position shown in FIG. 6 and with the transport litter and a floor of the emergency transport vehicle shown cut-away to illustrate an embodiment for interconnection between a longitudinal member of the patient transport litter and a receiver mounted to the floor of the emergency transport vehicle.

As noted above, the interconnection assembly 100 may include a receiver 110 mounted to the floor 212 of the emergency transport vehicle 200, and hand-control members 150, 152 mounted to a rear wall within cabin area 204 of emergency transport vehicle 200. The receiver 110 may include a laterally-accessible, u-shaped channel sized to receive the longitudinal member 80, wherein the channel is at least partially defined by a channel member 112. As shown, the receiver 110 may be positioned so that the channel is aligned parallel to a longitudinal axis of the predetermined area 210 within the emergency transport vehicle 200. The receiver 110 may further include a closure member 116 that is pivotally disposed relative to the channel member 112, wherein the closure member 116 is adapted to automatically pivot from an open-channel position to a closed-channel position upon receipt of the longitudinal member 80 within the u-shaped channel, as shown in FIG. 7.

When longitudinal member 80 is positioned within the channel of receiver 110, with rocker member 116 in a closed-channel position, side-to-side movement of patient transport litter 10 is restrained. The receiver 110 and longitudinal member 80 may be adapted to allow for slidable, longitudinal movement of the longitudinal member 80 and patient transport litter 10 relative to the receiver 110. By way of example, the patient transport litter 10 may be advanced from the position shown in FIGS. 6 and 7 to a more rearward position within the predetermined area 210 of emergency transport vehicle 200, as shown in FIG. 8.

In this regard, and referring again to FIG. 7, the longitudinal member 80 may be provided with a plurality of interconnection locations 82 disposed along at least a portion of the length thereof, and receiver 110 may be provided with a complimentary lock member (not shown in FIG. 6) for locking interface with any one of the plurality of interconnection locations 82. By way of example, the lock member of receiver 110 may comprise a spring-loaded pin member, and interconnection locations 82 may each comprise an aperture sized for receipt of the pin member thereinto. In this regard, the pin member may be biased by a spring member toward the longitudinal member 80 so as to automatically enter an aligned interconnection location 82. In turn, when pin member is located within any one of the interconnection locations 82 the patient transport litter 10 may be restricted from both longitudinal and lateral movement relative to the receiver 110 of the interconnection assembly 100, as well as the emergency transport vehicle 200.

To allow for selective positioning of the longitudinal member 80 and patient transport litter 10, relative to the receiver 110, the interconnection assembly 100 may include a control member interconnected to the lock member of receiver 110, e.g., wherein the control member is manipulable to retract a spring-loaded pin member of receiver 110 to allow for selective positioning and locking interface of longitudinal member 80 and patient support litter 10 relative to the receiver 110. By way of example, the control member may comprise a first cable 120*a* having a first end interconnected to a spring-loaded pin member of receiver 110 and a second end interconnected to hand-control member 152 (e.g. shown in FIG. 1), wherein the cable 120*a* is routed under the floor 212 therebetween. The hand-control member 152 may be manipulatable to selectively retract the pin member away from the longitudinal member 80 and interconnection locations 82 thereof to facilitate selective longitudinal positioning of the patient transport litter 10 to a desired retention location within the predetermined area 210. A second control cable 120*b* may also be provided for selective lateral release of longitudinal member 80 from receiver 110. More particularly, a first end of cable 120*b* may be interconnected to closure member 116 and a second end of cable 120*b* may be interconnected to hand-control member 150 (e.g., shown in FIG. 1), wherein cable 120*b* is routed under the floor 212 therebetween. The hand-control member 150 may be selectively manipulatable so as to move closure member 116 to an open-channel position to allow longitudinal member 80 of patient transport litter 10 to be removed from receiver 80 (e.g., for unloading after emergency transport).

As may be appreciated, during transport of a patient in emergency transport vehicle 200, the longitudinal position of patient support apparatus 10 within the predetermined area may be selectively modified via use of the control member. For example, the hand control member 152 may be manipulated to disengage a pin member of receiver 80 from longitudinal member 80 and the patient transport litter 10 may be selectively, rolled/advanced toward the front of an emergency transport vehicle 200 and locked in place so as to provide medical personnel with better access to the head of a patient positioned in patient transport litter 10. The patient transport litter 10 may be returned to a stow position using a reversed procedure.

After transport of patient support litter 10 on emergency transport vehicle 200 to a desired location, patient transport litter 10 may be selectively disengaged from the receiver 110 and rolled/advanced to side access port 202 for unloading. In conjunction with such unloading, the frame 30 of patient transport litter 10 may be selectively unfolded to the upright state shown in FIG. 1. Optionally the lateral member 70 may restrainably engage the retention member 90 to facilitate controlled handling. After unloading, patient transport litter 10 may be rolled to an acute care facility, or to another emergency transport vehicle for transport to an acute care facility.

In relation to the system embodiment described in relation to FIGS. 1-8, it is noted that, apart from the patient transport litter 10, various additional described componentry may be separately provided to adapt or retro-fit an emergency transport vehicle interior to operatively interface with the litter 10. In particular, floor 212 may be defined by one or more panels securable to flooring of an emergency transport vehicle. In turn, receiver 110, retention member(s) 90 and optional ramp 270 may be interconnected thereto, while control cables 120*a*, 120*b* may be routed thereunder. In turn, hand control members 150, 152 may be mounted to an interior wall or other surface of the emergency transport vehicle.

Figure 9:
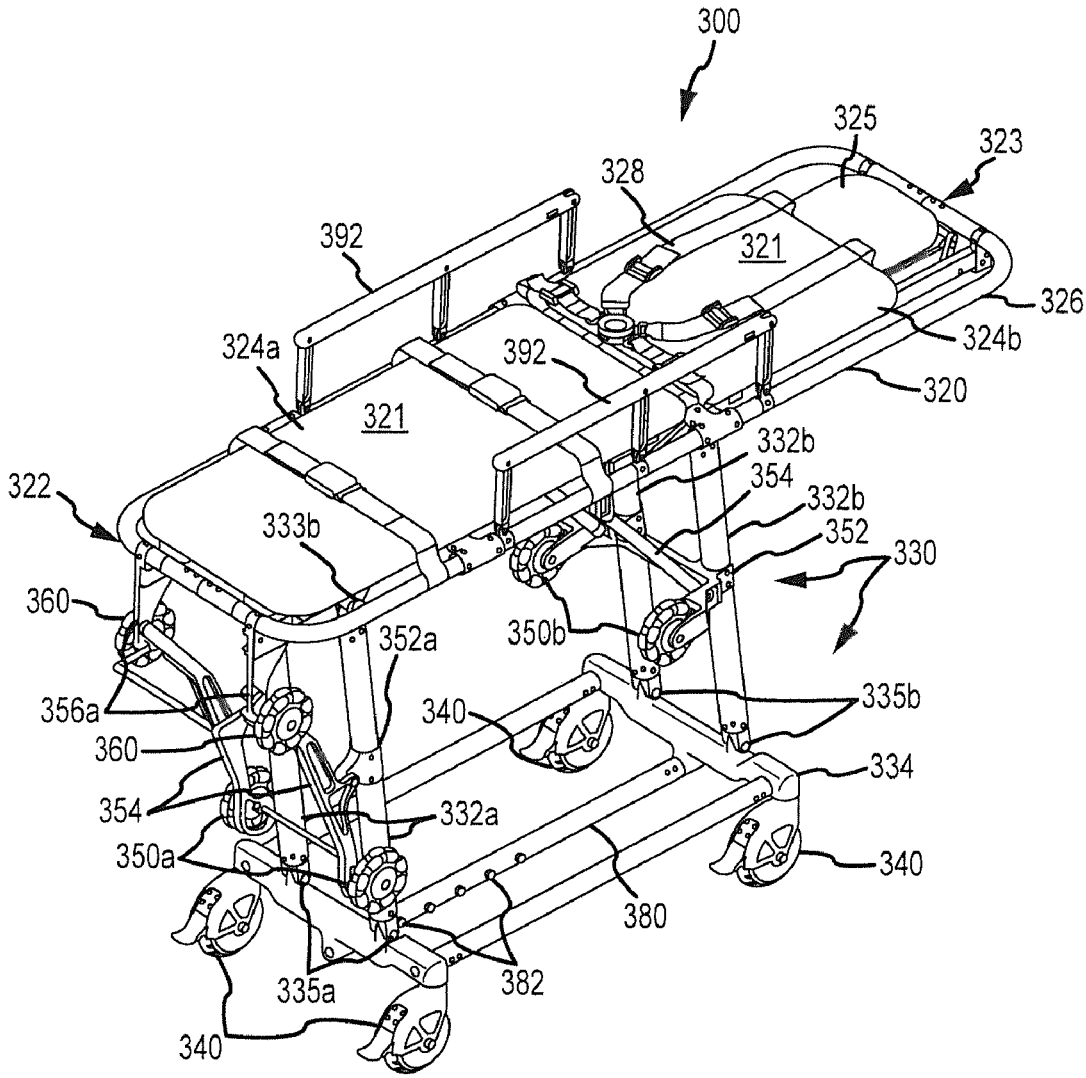
FIG. 9 is a first top isometric view of a patient transport litter embodiment employable in the patient handling system embodiment of FIGS. 1-8.
Figure 10:
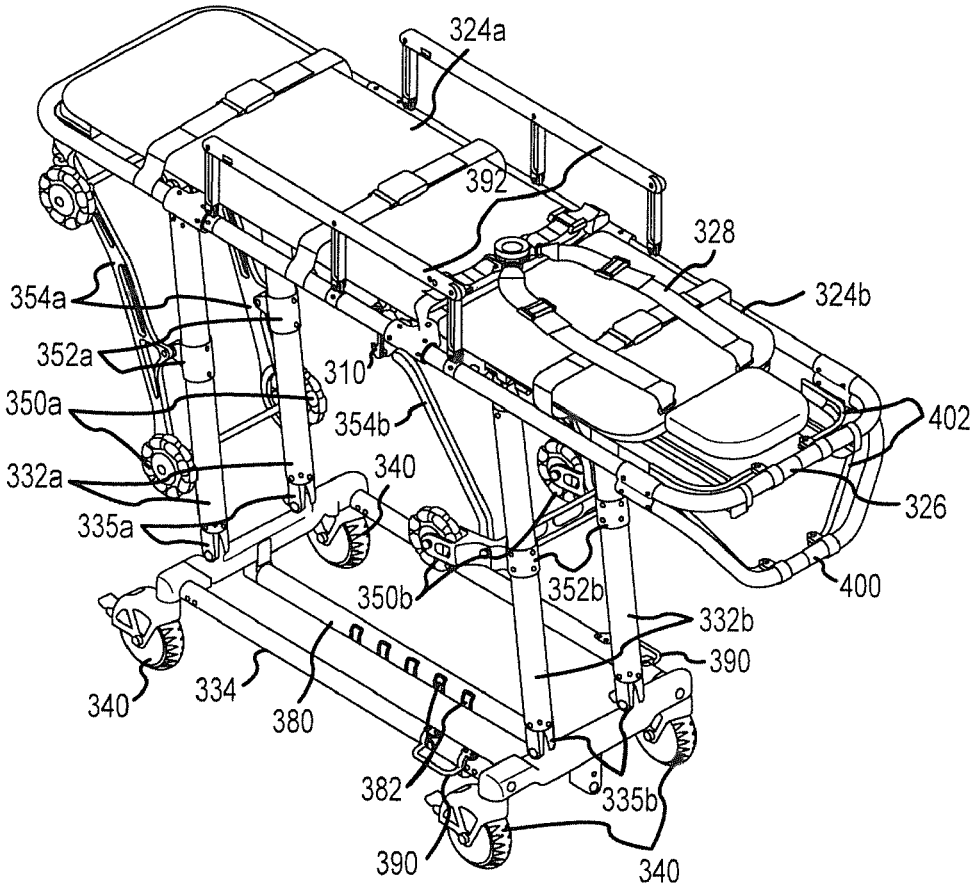
FIG. 10 is a second top isometric view of the patient transport litter embodiment of FIG. 9.
Figure 11:
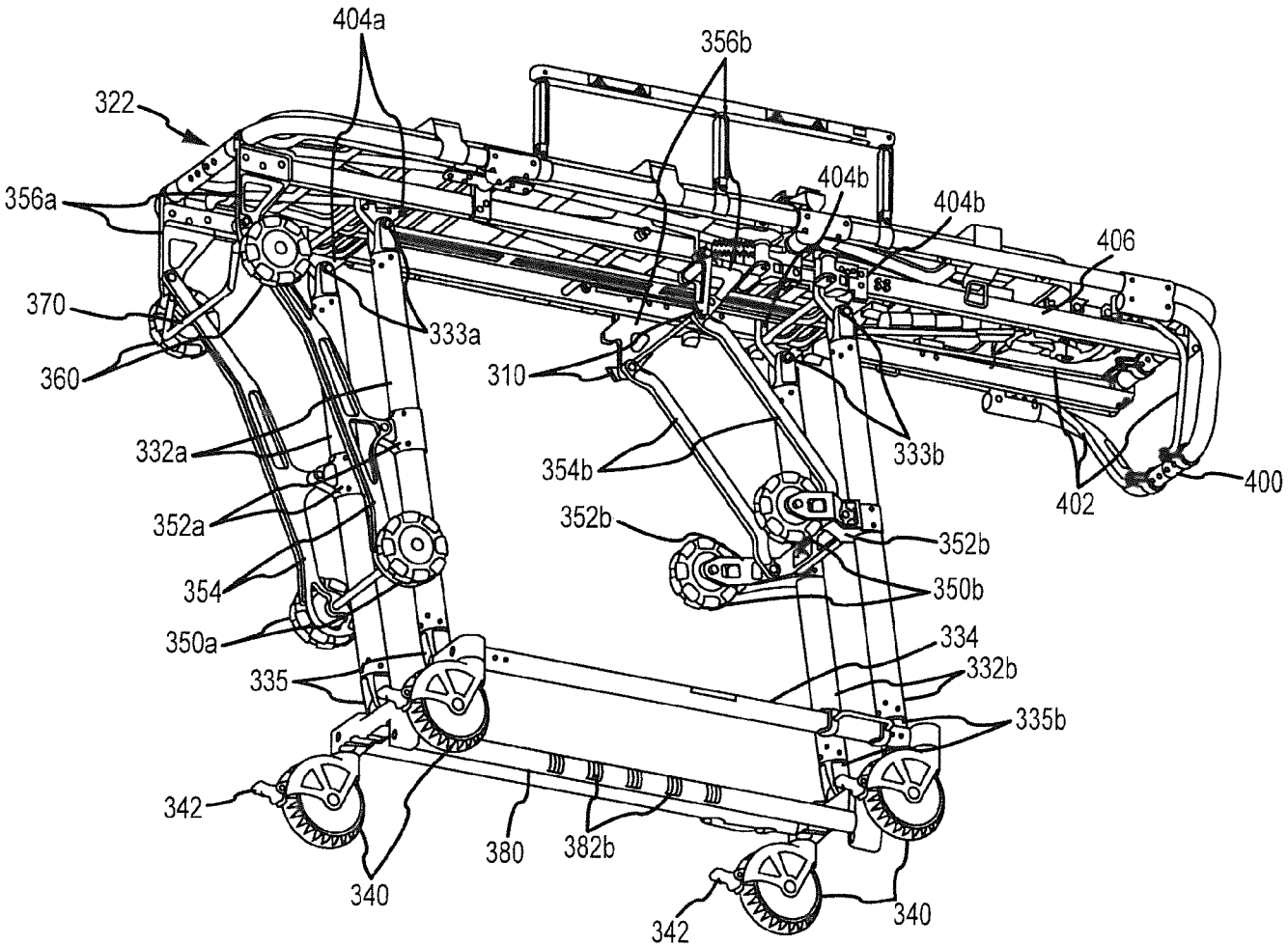
FIG. 11 is a first bottom isometric view of the patient transport litter embodiment of FIG. 9.

Reference is now made to FIGS. 9-11 which illustrate another embodiment of a foldable patient transport litter 300. The patient transport litter 300 includes a patient support platform 320 pivotally interconnected to a frame 330. The frame 330 includes first frame portions 332*a*, 332*b* pivotally interconnected to the patient support platform 320 at first connections 333*a*, 333*b*, and a second frame portion 334 pivotally interconnected to the first frame portions 332*a*, 332*b* at second connections 335*a*, 335*b*.

A first plurality of wheels 340 may be interconnected in fixed relation to the second frame portion 334 to facilitate rolling movement of the patient transport litter 300 in an unfolded state. As illustrated, the first plurality of wheels 340 may comprise caster wheels with selectively lockable members 342 to restrain roller movement when desired.

To facilitate rolling movement of the patient transport litter 300 in a folded state, a second plurality of wheels 350*a*, 350*b* may be interconnected in fixed relation to first frame portions 332*a*, 332*b*. The second plurality of wheels 350*a*, 350*b* may be multi-directional to facilitate rollable movement in all directions. Wheels 350*a* may be interconnected to one end of truss members 354*a* that are interconnected in fixed relation to first frame portion 332*a* via brackets 352*a*. Another end of truss members 354*a* may be pivotally interconnected to patient support platform 320 via brackets 356*a* at the first end 322 of the patient support platform 320. Wheels 350*b* may be interconnected in fixed relation to first frame portion 332*b* via brackets 352*b*. In turn, truss members 354*b* may be provided that are interconnected in pivotal relation to first frame portion 332*b*, e.g., at brackets 352*b*, and that are pivotally interconnected to patient support platform 320 via brackets 356*b* near the second end 323 of the patient support platform 320.

To facilitate rolling engagement of patient transport litter 300 with a support surface of an emergency transport vehicle during intial steps of loading thereupon and final steps of unloading therefrom, the patient transport litter 300 may be provided with a leading plurality of wheels 360 interconnected to a first end 322 of the patient support platform 320.

As shown, the leading plurality of wheels 360 may be multi-directional as described above.

A lateral member 370 may also be provided at the first end 322 of the patient support platform 320. The lateral member 370 may be provided to engage a retention member(s) mounted to a floor of an emergency transport vehicle is a manner analogous to that described in relation to the lateral member 70 and retention member(s) 90 of the embodiment of FIGS. 1-8. Further, a longitudinal member 380 may be interconnected to the second frame portion 334. As shown, the longitudinal member 380 may extend along a length of the patient transport litter 300 (e.g., along a longitudinal center axis) and may be disposed below (e.g., project downward from) the second frame portion 334. The longitudinal member 380 may comprise interconnection locations 382 (e.g., apertures) spaced along a portion thereof for selective linking interface with a receiver mounted to a floor of an emergency transport vehicle in a manner analogous to that described in relation to the longitudinal member 80/interconnection locations 82 and receiver 110 of the embodiment of FIGS. 1-8.

As shown in FIG. 9, the patient support platform 320 may include sections 324*a* and 324*b* interconnected to an external frame 326. Section 324*b* may be provided for selective and lockable, angular positioning relative to section 324*a*, so as to facilitate treatment of a patient in a partially upright position. In this regard, patient transport litter 300 is generally sized for positioning of a patient's upper body portion on section 324*b* and lower body portion on section 324*a*, wherein a patient's feet may be located near the first end 322 of patient support platform 320 and a patient's head may be located near a second end 323 of patient support platform. Each of the sections 324*a* and 324*b* may be padded for patient comfort. Further, section 324*b* may include a headrest 325. As shown, the patient support platform 320 may also include selectively connectable straps 328 to secure a patient to a top surface 321 of the patient support platform 320.

Referring now specifically to FIGS. 10 and 11, the patient transport litter 300 may include control members 400*a* and 400*b* (e.g., lateral handles) interconnected to the patient support platform 320 at the second end 323 thereof. The control member 400*a* may be operated by medical personnel to selectively unlock and position the patient transport litter 300 from an unfolded state, as shown in FIGS. 10 and 11, to a folded position as further described hereinbelow. In certain embodiments, control member 400*a* may also be utilized to selectively position and lock the patient transport litter 300 in one or more intermediate, or partially-folded, positions as will be described hereinbelow. The control member 400*b* may be operated to selectively release the patient transport litter 300 from a fully-folded, locked state to an unfolded state or partially-folded state.

In the illustrated arrangement, the control member 400*a* may be advanced, or squeezed, relative to the frame 326 at the second end 323 of the patient transport litter 300 (e.g., while anchoring the frame 326 at second end 323) to realize relative movement therebetween, wherein the patient transport litter 300 may be folded from an unfolded state to a fully-folded or partially-folded state. To unfold the patient transport litter 300 from a fully-folded state, control member 400*b* may be advanced, or squeezed, relative to the frame 326 at the second end of the patient transport litter 300 (e.g., while anchoring the frame 326 at second end 323).

The control member 400*a* may be interconnected via linkage members 402 to moveable members 404*a*, 404*b* (e.g., slide and/or roller members) interconnected to and longitudinally moveable in relation to rail members 406 (e.g., channel and/or cam members) that are fixedly interconnected to a bottom side of the patient support platform 320. The moveable members 404*b* may be provided to be lockable in set positions relative to the rail members 406 when the patient transport litter 300 is in an unfolded state, as shown in FIG. 11, and optionally at one or more partially-folded position(s) (e.g., via a spring-loaded pin and multiple-slot arrangement in which squeezing control member 400*a* causes the spring-loaded pin to exit a given slot to unlock the moveable members 404*b*).

Figure 12A:
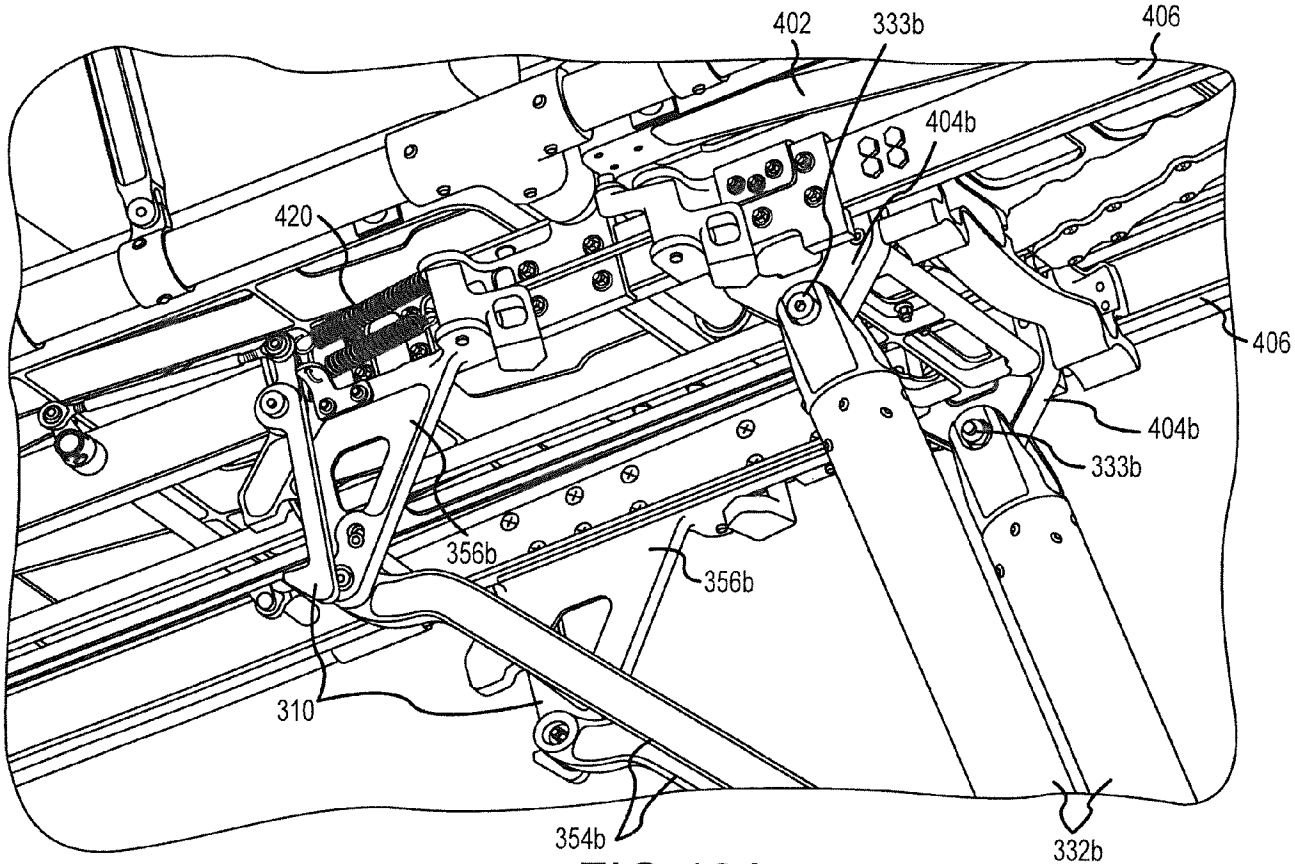
FIG. 12A is a segmented first bottom isometric view of a central portion of the patient transport litter embodiment of FIG. 9 in a fully-folded state.
Figure 12B:
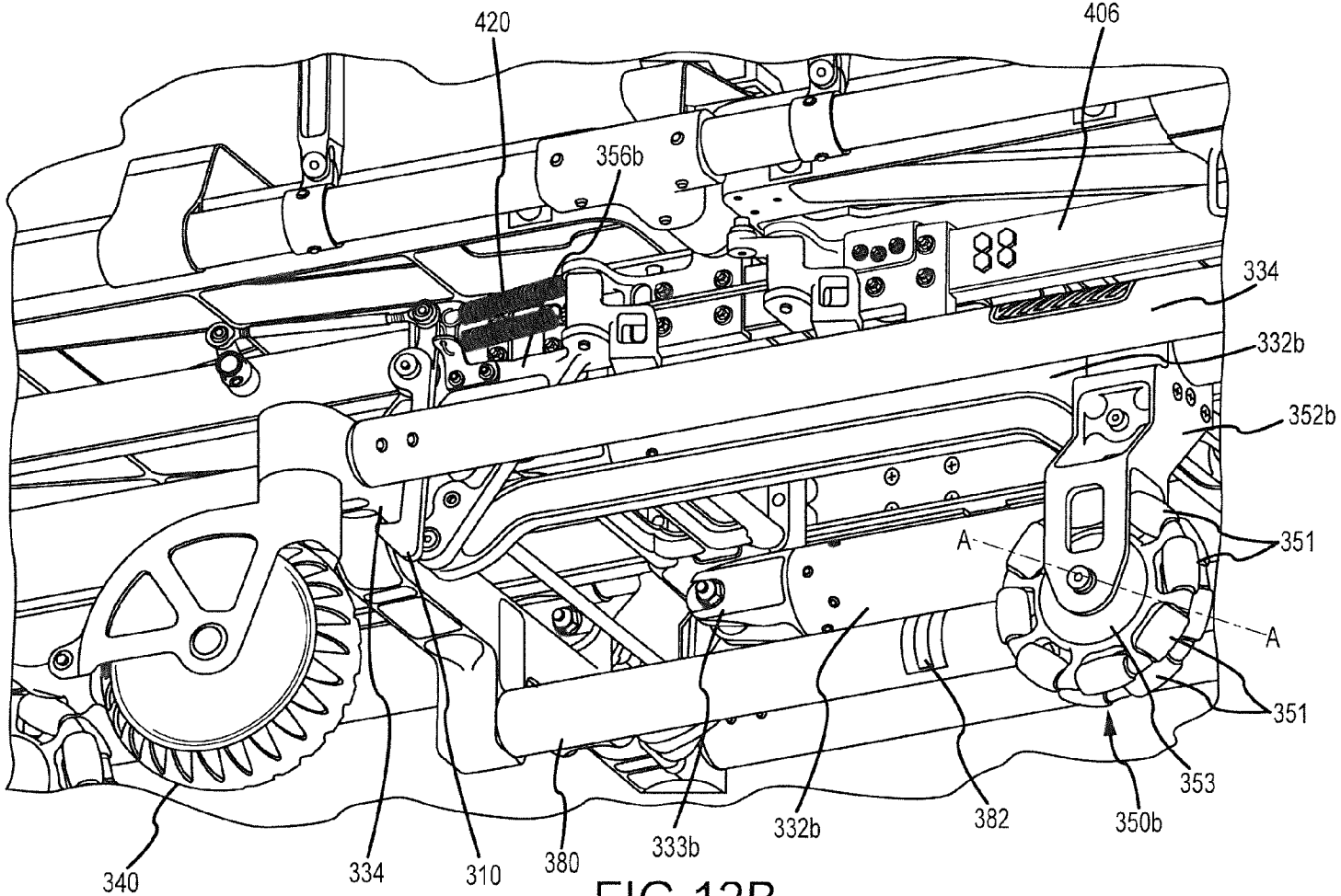
FIG. 12B is a segmented second bottom isometric view of a central portion of patient transport litter embodiment of FIG. 9 in a fully-folded state.

Reference is now made to, FIGS. 12A and 12B which illustrate segmented, bottom views of a central portion of the patient transport litter 300 in an unfolded state and folded state, respectively. As illustrated, first frame portion 332*b* may be pivotally interconnected to patient support platform 320 at interconnections 333*b* that are provided by moveable members 404*b*. Additionally, first frame portion 332*a* may be pivotally interconnected to patient support platform 320 at interconnections 333*a* that are provided by moveable members 404*a*.

As further shown by FIGS. 12A and 12B, the provision of first frame portions 332*a*, 332*b* that may be pivotally interconnected to patient support platform 320 at locations that may be longitudinally moved (e.g., lengthwise) along the patient support platform 320 facilitates folding and unfolding while also yielding compactness and controllable mass movement.

Latch members 310 may be interconnected to a bottom side of the patient support platform 320 (e.g., near bracket member(s) 356*b*). The latch members 310 may be pivotably interconnected to the patient support platform 320 and biased by corresponding springs 420 to assume the latch positions illustrated in FIGS. 12A and 12B. The latch members 310 may be provided to lock the patient support platform 320 in a fully-folded state by restrainably engaging the second frame portion 334 when the patient transport litter 300 is in a folded state, as shown in FIG. 12B. The latch member(s) 310 may also be interconnected to the control member 400*b*, wherein upon squeezing the control member 400*b*, the latch member(s) 310 may be pivoted so as to disengage, or unlock, from second frame portion 334 to allow patient transport litter 300 to be unfolded.

As further illustrated by FIG. 12B, wheels 350*b* may comprise multi-directional, wheels that are each provided with a plurality of rollers 351 disposed about a circular periphery of a wheel hub 353, wherein each of the wheels is rotatable about a corresponding wheel rotation axis AA. Further, each of the rollers 351 may be provided for separate rotation about corresponding roll axes, wherein the roll axes of rollers 351 are disposed in a common plane and/or parallel planes. Such an arrangement allows for rolling advancement of the patient transport litter 300 in a first direction via rotation of wheels 350*a*, 350*b* and in a second direction, transverse to the first direction, via rotation of rollers 351 of the wheels. In this regard, the litter 300 may be advantageously rolled in any selected direction. In turn, patient positioning to, within and from an emergency transport vehicle is facilitated.

Figure 13A:
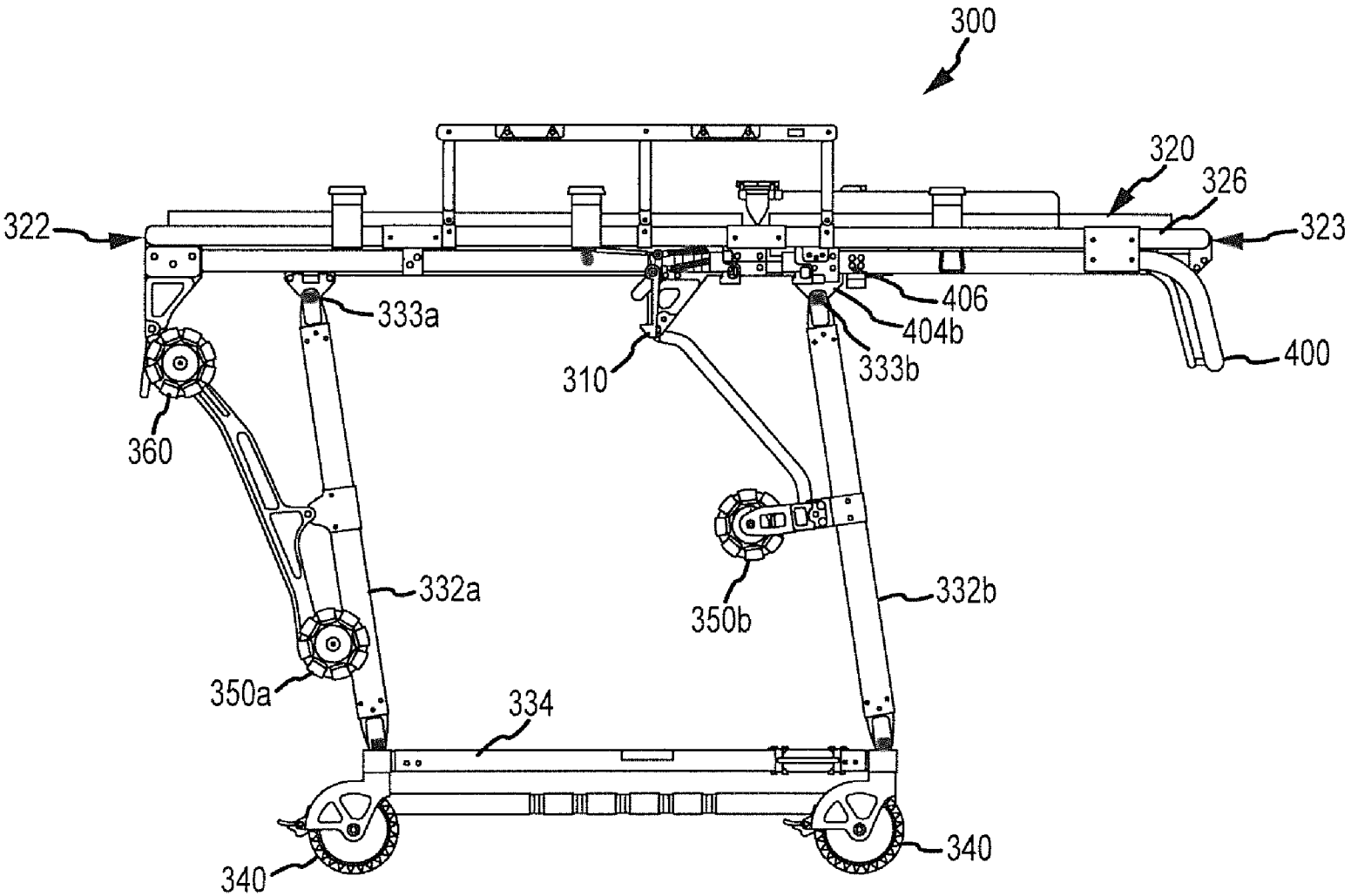
FIG. 13A, FIG. 13B, and FIG. 13C are side views of the patient transport litter embodiment of FIG. 9 shown in an unfolded state, partially-folded state and fully-folded state, respectively.
Figure 13B:
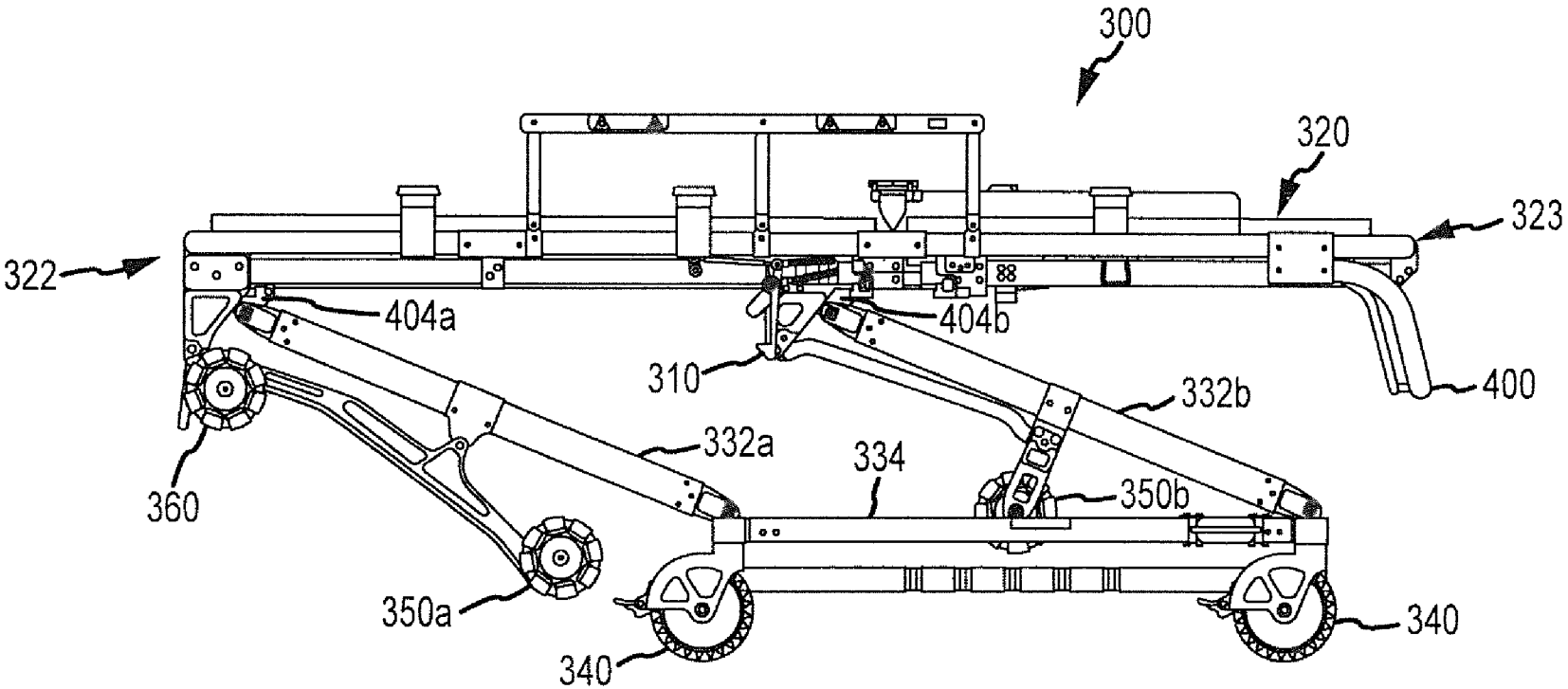
Figure 13C:
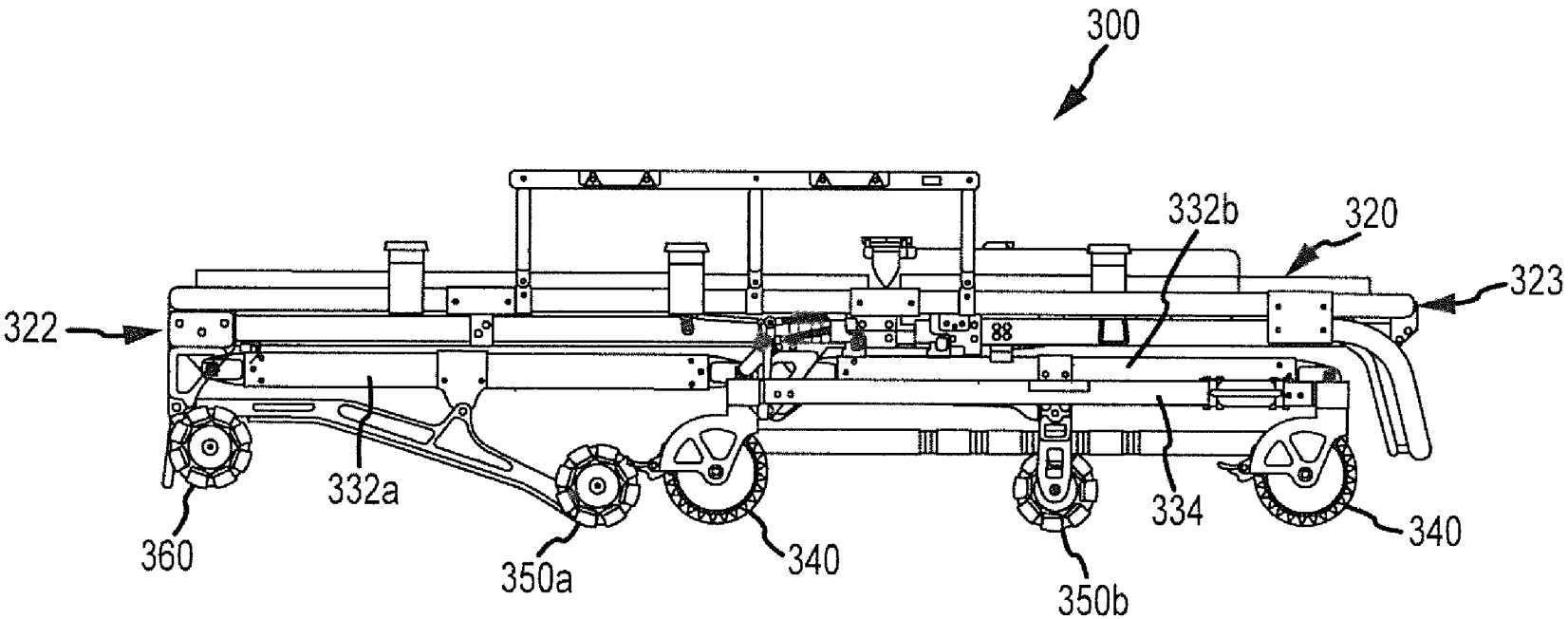

Reference is now made to FIGS. 13A, 13B and 13C, which illustrate patient transport litter 300 in an unfolded state, a partially-folded state and a folded state, respectively. As shown in FIG. 13A patient transport litter 300 is in an unfolded state, wherein it is rollable on the first plurality of wheels 340. As previously noted, the patient transport litter 300 may be maintained in the unfolded state, and optionally in a partially-folded state, via a locking interface between moveable members 404*b* and rail members 406. In the unfolded state, the patient support platform 320 and first frame portions 332*a*, 332*b* may be provided so as to be non-orthogonal at the interconnection locations 333*a*, 333*b*, and the first frame portions 332*a*, 332*b* and second frame portion 334 may be correspondingly provided to non-orthogonal at the interconnection locations 335*a*, 335*b*. For example, in the illustrated embodiment, first frame portion 332*a*, 332*b* are at an acute angle relative to the portions of the patient support platform 320 that extend towards the second end 323 thereof from interconnection locations 333*a*, 333*b*. As may be appreciated, such non-orthogonal positioning facilitates compactness when the patient transport litter 300 is positioned in a folded state or partially-folded state.

In that regard, and as noted, to fold the patient transport litter 300 first medical personnel may manipulate control member 400 relative to the frame 326 at second end 323 so as to selectively release the moveable members 404*b* from locked engagement with rail members 406. In conjunction with such operation, first medical personnel located at first end 322 and second medical personnel located at the second end 323 may supportably lower the patient transport platform 320 in a controlled manner.

As illustrated by a comparison of FIG. 13A and FIG. 13B, moveable members 404*a*, 404*b* move (e.g. slide in rails 406) towards the first end 322 of the patient support platform 320 as patient transport litter is folded from a non-folded state. Concomitantly, first frame portions 332*a*, 332*b* have pivoted relative to patient support platform 320, and moveable members 404*a*, 404*b*. In short, moveable members 404*a*, 404*b* advantageously provide longitudinally moveable pivot locations 333*a*, 333*b* for folding and unfolding purposes. As further reflected by the comparison of FIG. 13A and FIG. 13B, during folding of the patient transport litter 300 from the unfolded position shown in FIG. 13A to the partially-folded position shown in FIG. 13B, the moveable members 404*b* disposed adjacent to second end 323 have moved a lesser distance relative to patient transport platform 320 than the moveable members 404*a* disposed adjacent to first end 322 of the patient transport platform 320. In the partially-folded position shown in FIG. 13B, moveable members 404*a*, 404*b* may be restrained from further movement along rail members 406.

Reference is now made to FIG. 13C which illustrates patient transport litter 300 further folded from the partially-folded position shown in FIG. 13B to a fully-folded position. In conjunction with such further folding movement, the first frame portions 332*a*, 332*b* have further pivoted in a direction corresponding with the first end 322 of the patient transport platform 320, wherein a compact folded arrangement is realized as shown in FIG. 13C. As further illustrated in FIG. 13C, when in the fully-folded position, the second plurality of wheels 350*a*, 350*b* are disposed at a greater distance below patient transport platform 320 than the first plurality of wheels 340, thereby lifting the first plurality of wheels 340 off a support surface to facilitate rolling movement of patient transport litter 300 on the second plurality of wheels 350*a*, 350*b* in the fully-folded position. Further in this regard, when in the fully-folded position shown in FIG. 13C the latch members 310 retainably engage the second frame portion 354.

Figure 14A:
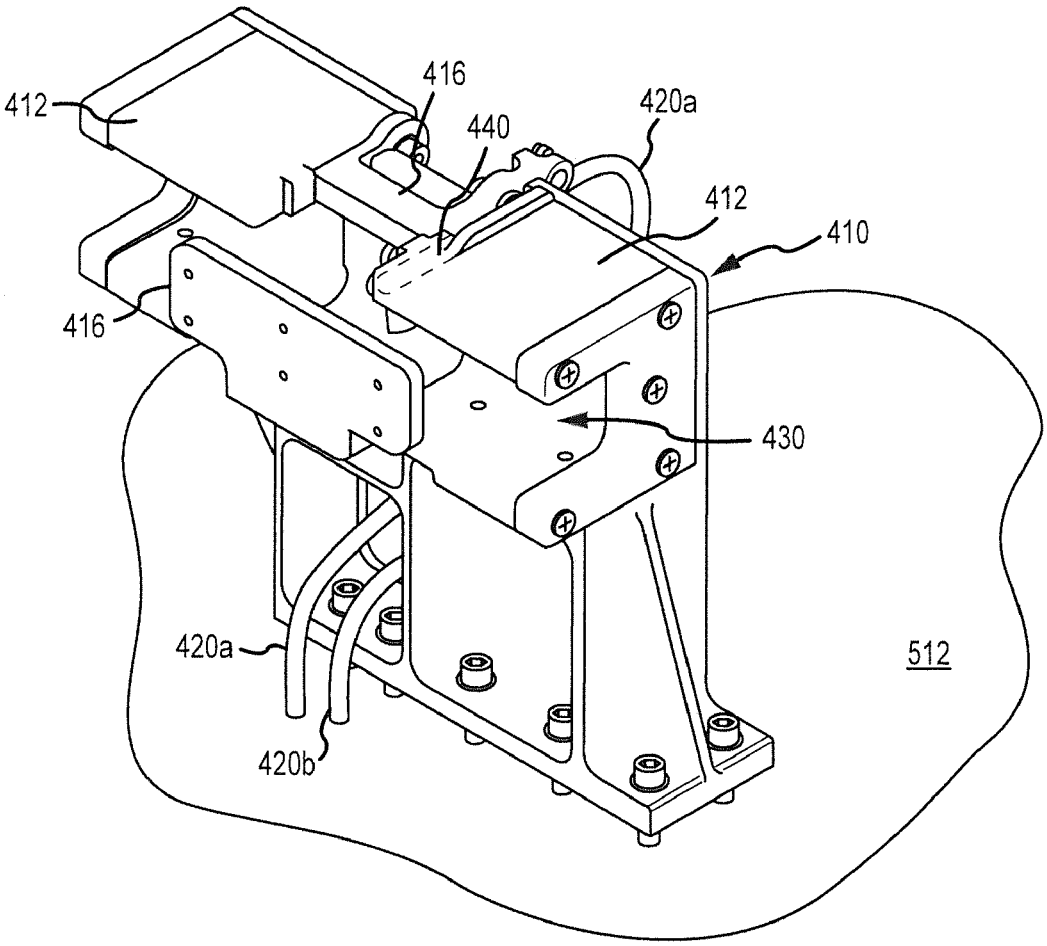
FIG. 14A is a first elevated isometric view of a receiver embodiment for selective lockable positioning of the patient transport litter embodiment of FIG. 9 on an emergency transport vehicle.
Figure 14B:
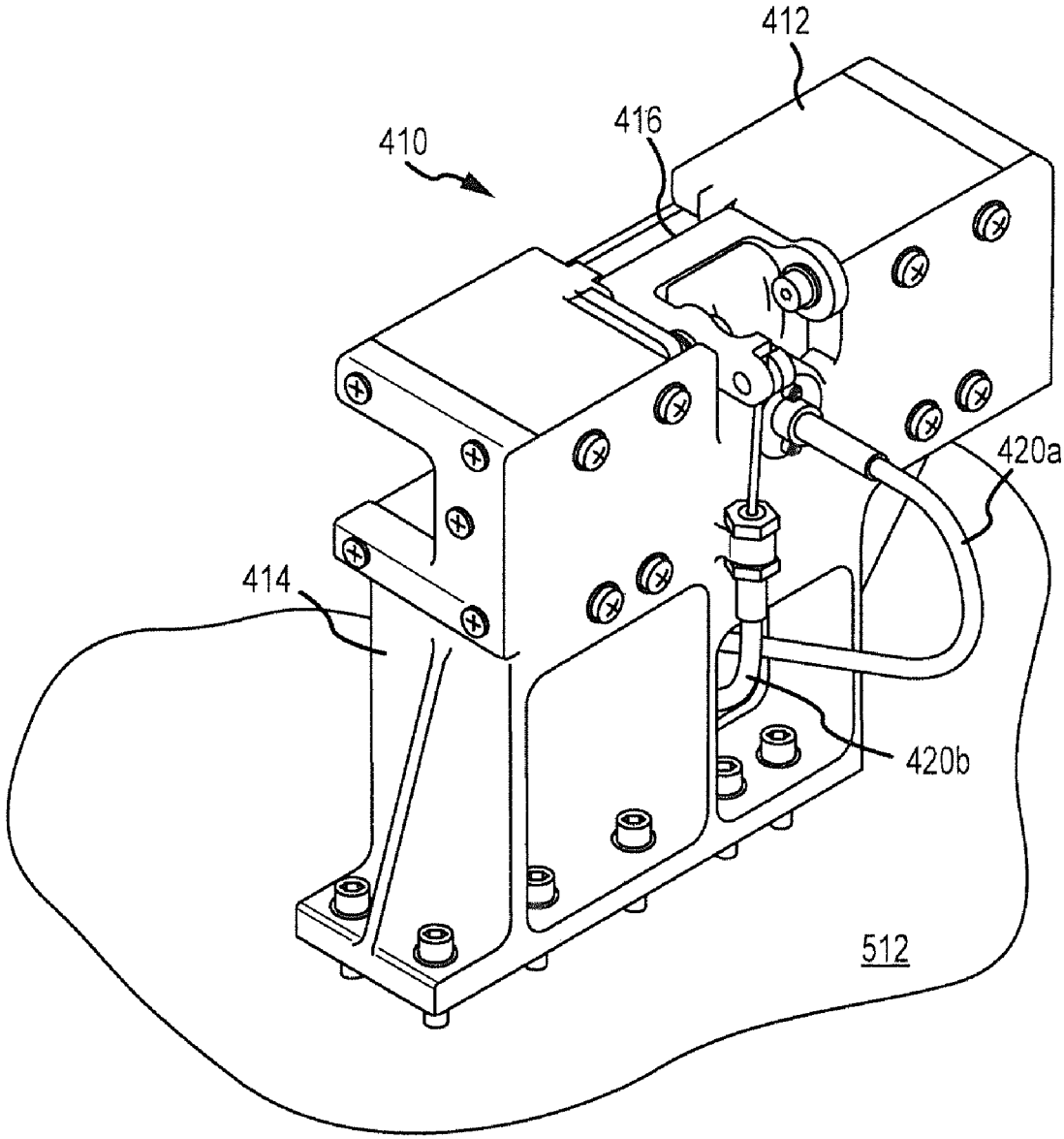
FIG. 14B is a second elevated isometric view of the receiver embodiment of FIG. 14A.

Reference is now made to FIGS. 14A and 14B which illustrate a receiver 410 mountable to the floor 512 of an emergency transport vehicle for selective lockable, interconnection with the patient transport litter 300. The receiver 410 may include a laterally-accessible, u-shaped channel 430 sized to receive the longitudinal member 380 of the patient transport litter 300. As illustrated, the channel 430 may be defined by u-shaped blocks 412 oriented laterally and mounted to a support 414. The receiver 410 may further include a closure member 416 that is located between and pivotally disposed relative to the u-shaped blocks 412. The closure member 416 may be interconnected to a control cable 420*b* that may be interconnected to a hand control member that may be selectively manipulatable to pivot the rocker member 416 from the closed position shown in FIG. 14A to an open position for receipt and/or release of the longitudinal member 380 relative to channel 430. In some arrangements, the closure member 416 may automatically pivot to the closed position shown in FIG. 14A when the longitudinal member 380 is presented to channel 430.

As may be appreciated, when the longitudinal member 380 is located within the channel 430 of receiver 400, with closure member 416 in the closed position, lateral movement of patient transport litter 300 is restrained. In this regard, the receiver 410 and longitudinal member 380 may be adapted to allow slidable, longitudinal movement of the longitudinal member 380 and patient transport litter 300 relative to the receiver 410. Further, the receiver 410 and longitudinal member 380 may be operable to selectively lock the longitudinal member 380 and patient transport litter 300 in a desired longitudinal position relative to the receiver 410 (e.g., along an axis corresponding with a center axis of channel 430).

In one approach, the longitudinal member 380 may be provided with the plurality of interconnection locations 382 defined by apertures as illustrated in FIG. 9 hereinabove. Such apertures may be sized to receive a spring loaded pin member 440 comprising receiver 410 (shown in phantom lines in FIG. 14A). In this regard, the pin member 440 may be biased by a spring member toward the longitudinal member 380 when positioned in channel 430, so as to automatically project in to an aligned interconnection aperture 382. In turn, when pin member 440 is located within any given one of the interconnection apertures 382 the patient transport litter 300 may be restricted from both longitudinal and lateral movement relative to the receiver 410.

To allow for selective positioning of the longitudinal member 380 and patient transport litter 300, relative to receiver 410, the pin member 440 may be interconnected to a control cable 420A that may be interconnected to a hand-control member that is selectively manipulatable to retract the pin member 440 away from longitudinal member 380. In this regard, such hand-control member may be utilized to selectively position and lock the longitudinal member 380 and patient transport litter 300 in any one of a plurality of longitudinal locations relative to receiver 410 utilizing a selective one of the plurality of interconnection locations defined by apertures 382.

As may be appreciated, the patient transport litter 300 and receiver 410 described in relation to FIGS. 9-14A & 14B may be utilized in conjunction with the system features described in relation to the embodiment of FIGS. 1-8.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain known modes of practicing the invention and to enable others skilled in the art to utilize the invention in such or other embodiments and with various modifications required by the particular application(s) or use(s) of the present invention. It is intended that the appended claims be construed to include alternative embodiments to the extent permitted by the prior art.

What is claimed is:

1. A portable patient transport litter, comprising:

a patient support platform for supporting a patient thereupon;

a frame interconnected to said patient support platform and selectively foldable between an unfolded state and a folded state;

a first plurality of wheels interconnected to said frame and supporting said frame and said patient support platform with said frame in said unfolded state; and a second plurality of wheels interconnected to said frame for supporting, independently of said first plurality of wheels, said frame and patient support platform with said frame in said folded state, each of said second plurality of wheels being multi-directional, wherein for a given common orientation of said second plurality of wheels said portable patient transport litter is rollable in at least two different directions with said frame in said folded state.

2. A portable patient transport litter as recited in claim 1, wherein each of said second plurality of wheels comprises:

at least a first plurality of roll members interconnected and disposed about a circle for rotation together about a wheel rotational axis, and wherein each of said roll members is separately rollable about a corresponding roll axis that is transverse to said wheel rotational axis.

3. A portable patient transport litter as recited in claim 1, further comprising:

a third plurality of wheels interconnected to and extending away from an end portion of said patient support platform, wherein said third plurality of wheels does not include said first or second plurality of wheels.

4. A portable patient transport litter as recited in claim 3, wherein each of said third plurality of wheels is multi-directional, wherein for a given common orientation of said third plurality of wheels said patient support platform is rollable in at least two different directions.

5. A portable patient transport litter as recited in claim 4, wherein each of said third plurality of wheels comprises:

at least a first plurality of roll members interconnected for rotation together about a wheel rotational axis, and wherein each of said roll members is separately rollable about a corresponding roll axis that is transverse to said wheel rotational axis.

6. A portable patient transport litter as recited in claim 1, wherein said frame comprises:

a first frame portion pivotally interconnected to said patient support platform; and a second frame portion, wherein said first frame portion is pivotally interconnected to said second frame portion, and wherein said patient support platform is selectively pivotable between a first position with said frame in said unfolded state and a second position with said frame in said folded state, said first position being elevated relative to said second position.

7. A portable patient transport litter as recited in claim 6, wherein said patient support platform is maintainable in a predetermined orientation relative to said second frame portion with said frame in said unfolded state and said folded state, and throughout pivotal movement of said patient support platform between said first and second positions.

8. A portable patient transport litter as recited in claim 6, wherein said first frame portion is slidable relative to said patient support platform, wherein said patient support platform is slidable from a first location relative to said first frame portion to a second location relative to said first frame portion in conjunction with pivotal movement of said patient support platform between said first position and said second position.

9. A portable patient transport litter as recited in claim 6, further comprising:

a third plurality of wheels interconnected to and extending away from an end portion of said patient support platform.

10. A portable patient transport litter as recited in claim 6, wherein said second frame portion comprises:

a plurality of connection locations disposed along a length of the portable patient transport apparatus for connection of a selected one of the plurality of connector locations with a complimentary connection member mounted to an emergency transport vehicle.

11. A method for emergency transport of a patient, comprising:

positioning a patient on a patient support platform of a portable patient transport litter;

moving the portable patient transport litter with the patient to an emergency transport vehicle, said moving step comprising rolling the portable patient transport litter with the patient on a first plurality of wheels of the portable patient transport litter;

loading the portable patient transport litter with the patient into said emergency transport vehicle through a side access port located on a side of the emergency transport vehicle, said loading step comprising folding a frame comprising the portable transport litter from an unfolded state to a folded state; and rolling, independently of the first plurality of wheels, the portable patient transport litter with the patient on a second plurality of wheels of the portable patient transport litter to a desired location within the emergency transport vehicle, wherein for a given common orientation of the second plurality of wheels the portable patient transport litter is rollable in at least two different directions.

12. A method as recited in claim 11, wherein said rolling comprises:

rotating each of said second plurality of wheels about corresponding wheel rotation axes in a first direction, wherein each of said second plurality of wheels comprises at least one plurality of roll members interconnected and disposed about a circle; and rolling at least one of said at least one plurality of roll members of each of said second plurality of wheels in a second direction.

13. A method as recited in claim 11, wherein said frame comprises a first frame portion and a second frame portion, and wherein said folding step comprises:

pivoting said patient support platform with the patient relative to said first frame portion, and said first frame portion relative to said second frame portion.

14. A method as recited in claim 13, wherein said folding step further comprises:

moving said patient support platform with the patient relative to said first frame portion.

15. A method as recited in claim 11, further comprising:

retaining a first end of the patient support platform at a location proximate to said side access port of said emergency transport vehicle.

16. A method as recited in claim 11, wherein said loading step further comprises:

rolling a first end portion of the patient support platform with the patient on another plurality of wheels comprising the portable patient transport apparatus.

17. A method as recited in claim 11, further comprising:

positioning a first connection member of said portable patient transport litter within a connector affixed to the emergency transport vehicle at the desired location, wherein the portable patient transport litter is restrained from movement in at least one direction.

18. A method as recited in claim 17, further comprising:

adjusting the position of the portable patient transport litter relative to and with the first connection member located within the connector; and releasably locking the portable patient transport litter into a selected one of a plurality of transport positions relative to the connector.

19. A method as recited in claim 17, further comprising:

locating the portable patient transport litter on another emergency transport vehicle.

20. A method as recited in claim 19, further comprising:

positioning a second connection member of said portable patient transport litter within another connector affixed to the another emergency transport vehicle, wherein the portable patient transport litter is restrained from movement in at least one direction.

21. A method as recited in claim 20, further comprising:

adjusting the position of the portable patient transport litter relative to and with the second connection member located within the another connector; and releasably locking the portable patient transport litter into a selected one of a plurality of transport positions relative to the another connector.

22. A method as recited in claim 11, wherein said moving step comprises rolling the portable patient transport litter over a support surface on the first plurality of wheels, and wherein the method further comprises during said folding step:

lifting the first plurality of wheels away from the support surface; and contacting the second plurality of wheels with the support surface.

23. A portable patient transport litter as recited in claim 6, wherein a center of mass of said patient support platform and a center of mass of said frame are laterally movable relative to each other relative to a support surface to maintain a desired center of mass of said portable patient transport litter over said support surface in conjunction with pivotal movement of said patient support platform between said first position and said second position.

24. A portable patient transport litter as recited in claim 1, wherein said first plurality of wheels is disposed at a different distance from said patient support platform than is said second plurality of wheels when said frame is in each of said unfolded and folded states.

25. A portable patient transport litter as recited in claim 24, wherein said first plurality of wheels is spaced farther from said patient support surface than is said second set of wheels in said unfolded state.

26. A portable patient transport litter as recited in claim 24, wherein said second plurality of wheels is spaced farther from said patient support surface than is said first set of wheels in said unfolded state.

* * * * *